US010973286B2

(12) United States Patent
Everts et al.

(10) Patent No.: US 10,973,286 B2
(45) Date of Patent: Apr. 13, 2021

(54) DEVICE, SYSTEM AND METHODS OF USE AND PRODUCTION FOR PREVENTING CHAINS OF A PLURALITY OF NECKLACES SIMULTANEOUSLY WORN BY A USER FROM ENTANGLING

(71) Applicant: Michelle K. Everts, Wilton, NY (US)

(72) Inventors: Michelle K. Everts, Wilton, NY (US); Darrell K. Everts, Schenectady, NY (US)

(73) Assignee: Michelle K. Everts, Wilton, NY (US)

( * ) Notice: Subject to any disclaimer, the term of this patent is extended or adjusted under 35 U.S.C. 154(b) by 0 days.

(21) Appl. No.: 16/620,601

(22) PCT Filed: Jul. 31, 2019

(86) PCT No.: PCT/US2019/044425

§ 371 (c)(1),
(2) Date: Dec. 9, 2019

(87) PCT Pub. No.: WO2020/033207

PCT Pub. Date: Feb. 13, 2020

(65) Prior Publication Data

US 2020/0297081 A1 Sep. 24, 2020

Related U.S. Application Data

(63) Continuation of application No. 16/243,869, filed on Jan. 9, 2019, which is a continuation-in-part of
(Continued)

(51) Int. Cl.
*A44C 5/00* (2006.01)
*A44C 5/20* (2006.01)
(Continued)

(52) U.S. Cl.
CPC ..... *A44C 5/2095* (2013.01); *A44C 13/00* (2013.01); *A44C 15/005* (2013.01); *A44D 2203/00* (2013.01)

(58) Field of Classification Search
CPC ..... A44C 5/2033; A44C 5/209; A44C 5/2009; A44C 5/2014; A44C 5/2042;
(Continued)

(56) References Cited

U.S. PATENT DOCUMENTS 850,234 A 4/1907 Lambert
1,813,963 A 7/1931 Schick
(Continued)

FOREIGN PATENT DOCUMENTS

DE 1947742 A1 * 4/1971 ..... A44C 5/209
DE 1947742 A1 4/1971
GB 1154733 6/1969

OTHER PUBLICATIONS

Layered necklace spacer clasp, https://www.etsy.com/listing/567201183/layered-necklace-spacer-clasp-gold, printed Aug. 7, 2018.
(Continued)

*Primary Examiner* — Jack W Lavinder
(74) *Attorney, Agent, or Firm* — Jay R. Yablon

(57) ABSTRACT

A necklace chain entangling preventer apparatus and related method of use and production for preventing necklace chains from entangling when simultaneously worn by a user thereof, comprising a first entangling preventer half and a second entangling preventer half, each the entangling preventer half comprising: a substantially flat rigid body plate; a plate-half attachment facilitator permanently affixed to the body plate; a plurality of N substantially rigid necklace chain threading hooks permanently affixed to the body plate; a plurality of N necklace chain threading retainers permanently affixed to the body plate; the plate-half attachment
(Continued)

facilitators affixed to their respective rigid body plates with opposite mating configurations; and a plurality of N necklace chain threading retainers, selected from the necklace retainer group consisting of: a malleable material retainer, a pivot retainer, a pole retainer, and an opposite plate inverted hook passively-engaged retainer.

27 Claims, 14 Drawing Sheets

Related U.S. Application Data application No. 16/057,151, filed on Aug. 7, 2018, now abandoned, and a continuation-in-part of application No. 16/057,151, filed on Aug. 7, 2018, now abandoned.

(51) Int. Cl.
*A44C 15/00* (2006.01)
*A44C 13/00* (2006.01)

(58) Field of Classification Search
CPC ..... A44C 5/2095; A44C 13/00; A44C 15/005; A44D 2203/00
USPC ..... 63/21, 33, 3.1
See application file for complete search history.

(56) References Cited

U.S. PATENT DOCUMENTS

| | | | | |
|---|---|---|---|---|
| 2,644,992 | A | 7/1953 | McFarland | |
| 3,974,545 | A | 8/1976 | Lossini | |
| 4,527,316 | A | 7/1985 | Murphy | |
| 4,549,411 | A | 10/1985 | Ivey | |
| 5,341,659 | A | 8/1994 | Wright | |
| 5,369,854 | A | 12/1994 | Stephens | |
| 5,687,585 | A | 11/1997 | Ferrell | |
| 6,880,363 | B2 | 4/2005 | Ms | |
| 8,205,471 | B2 | 6/2012 | McLees | |
| 2003/0010057 | A1 | 1/2003 | Hunter | |
| 2004/0194502 | A1 | 10/2004 | Ma | |
| 2010/0257898 | A1 | 10/2010 | Bonilla | |
| 2011/0119876 | A1 | 5/2011 | Goodman | |
| 2012/0291243 | A1 | 11/2012 | Baines | |
| 2013/0199239 | A1 | 8/2013 | Walker | |
| 2016/0166018 | A1 | 6/2016 | Morinville | |
| 2016/0183664 | A1 | 6/2016 | Gibbs | |
| 2018/0343992 | A1 | 12/2018 | Everts | |
| 2019/0174888 | A1 | 6/2019 | Everts | |
| 2020/0000186 | A1* | 1/2020 | Hansen | A44C 15/005 |

OTHER PUBLICATIONS

Layered Necklace Detangler, https://www.etsy.com/listing/281211064/layered-necklace-detangler-multi-strand, printed Aug. 7, 2018.
International Search Report (ISR) from ISA/IL, dated Nov. 11, 2019.
Written Opinion of the International Searching Authority, dated Nov. 11, 2019.

* cited by examiner

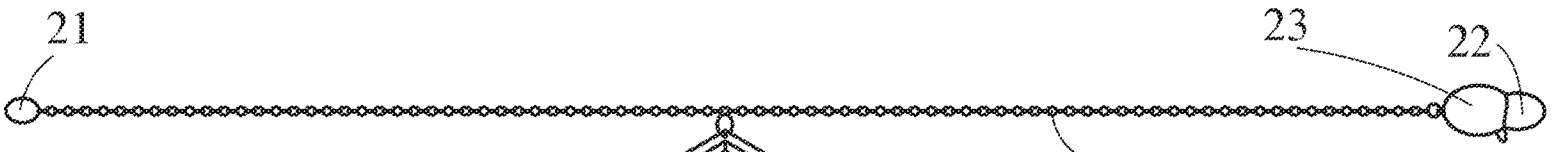
Figure 2 (Prior art)
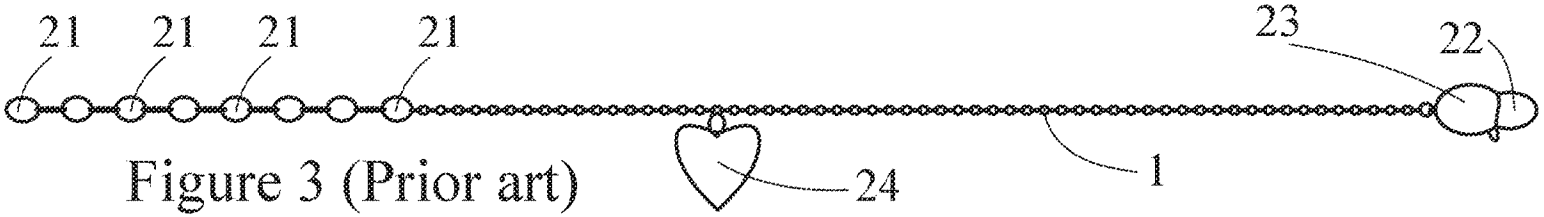
Figure 3 (Prior art)
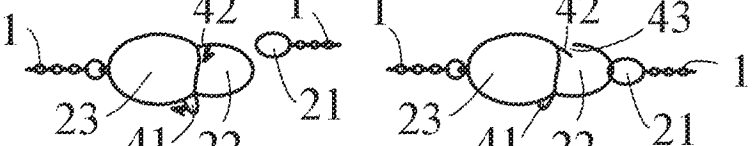
Figure 4A (Prior art)
Figure 4B (Prior art)
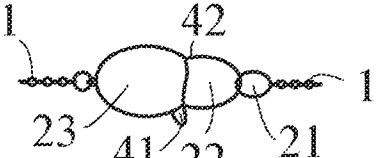
Figure 4C (Prior art)
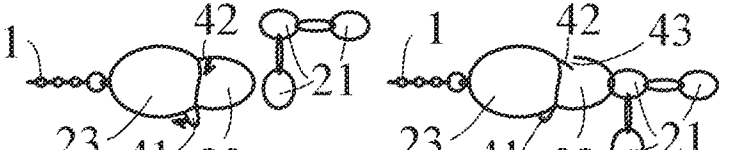
Figure 5A (Prior art)
Figure 5B (Prior art)
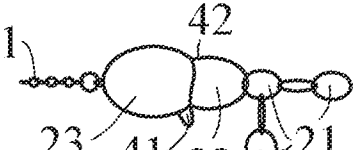
Figure 5C (Prior art)

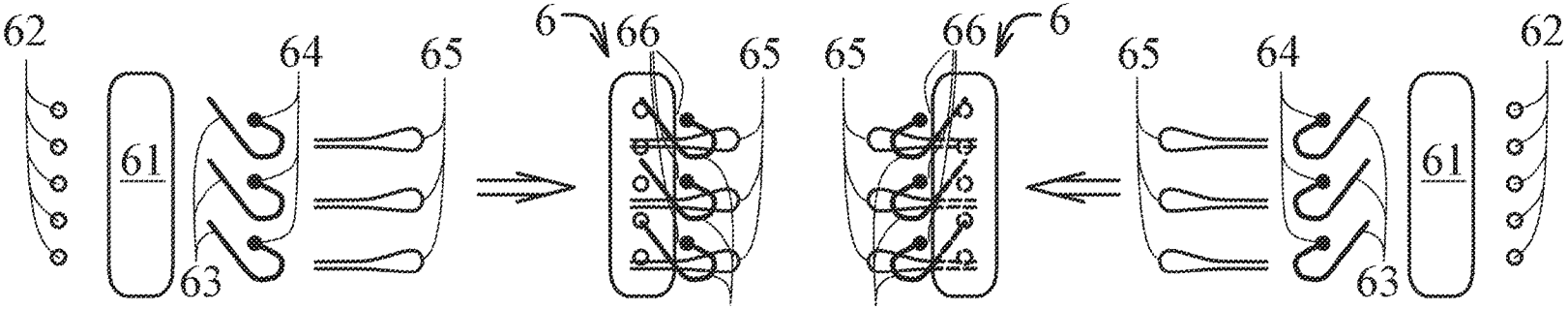
Figure 6A
Figure 6B
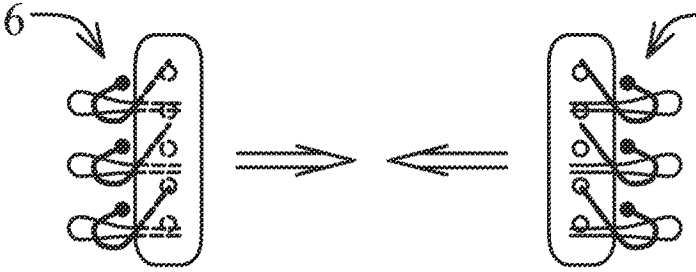
Figure 7
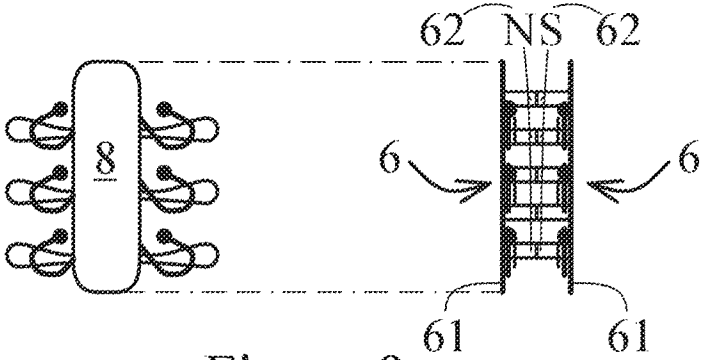
Figure 8

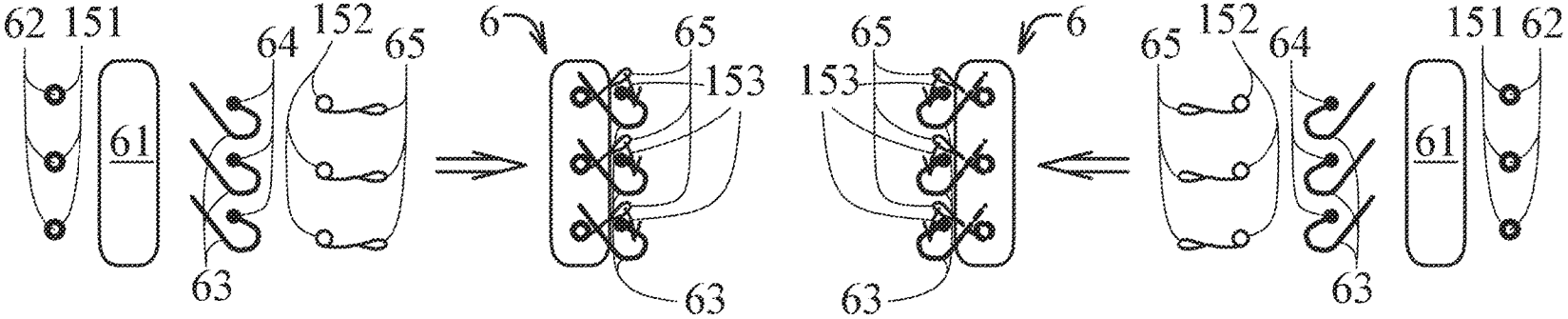
Figure 15A
Figure 15B
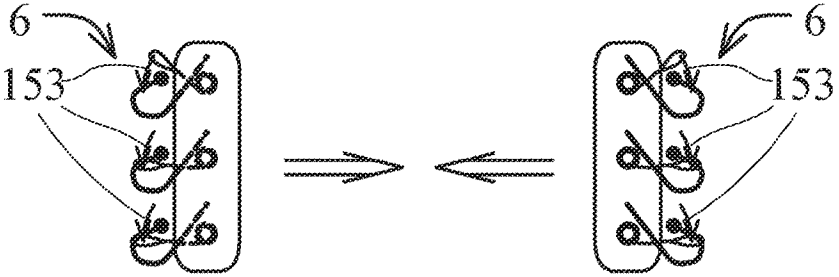
Figure 16
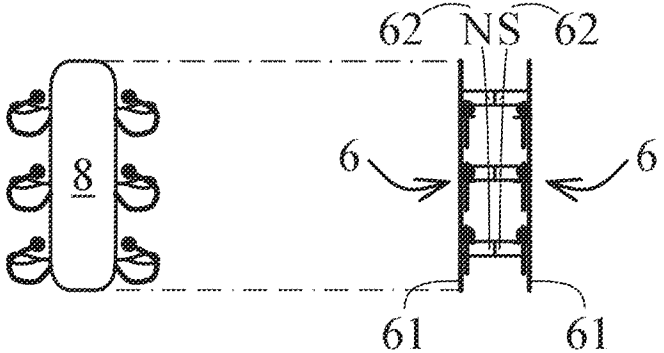
Figure 17

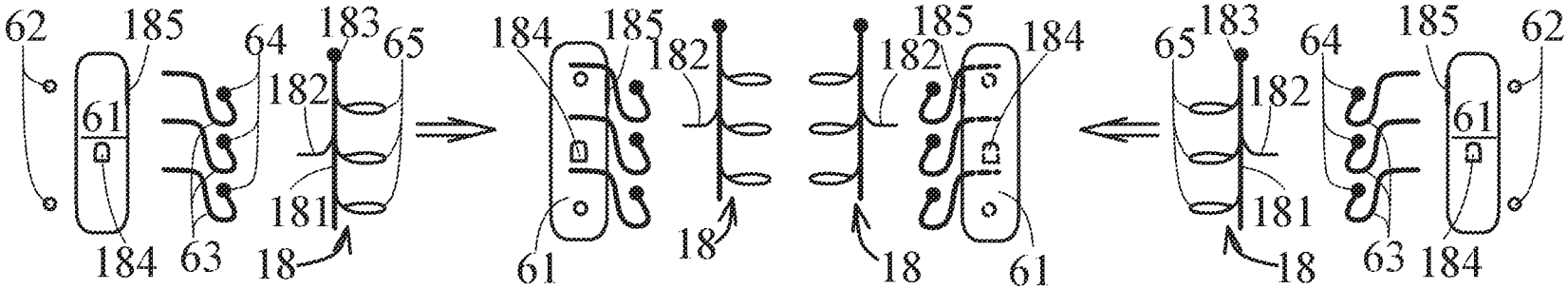
Figure 18A
Figure 18B
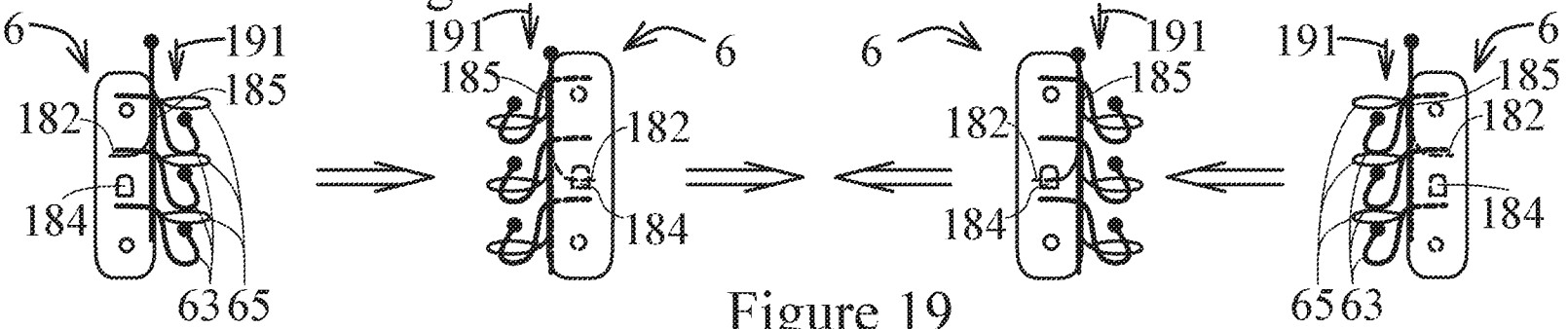
Figure 19
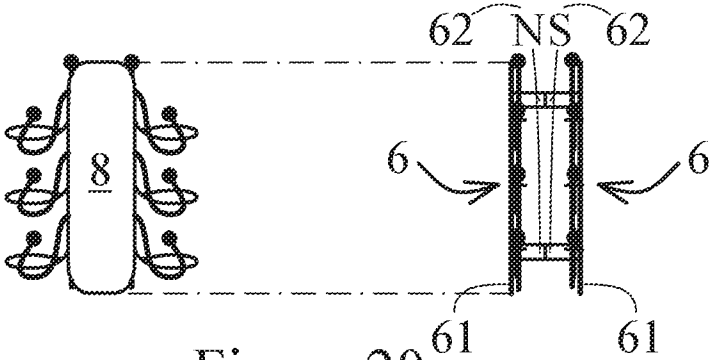
Figure 20

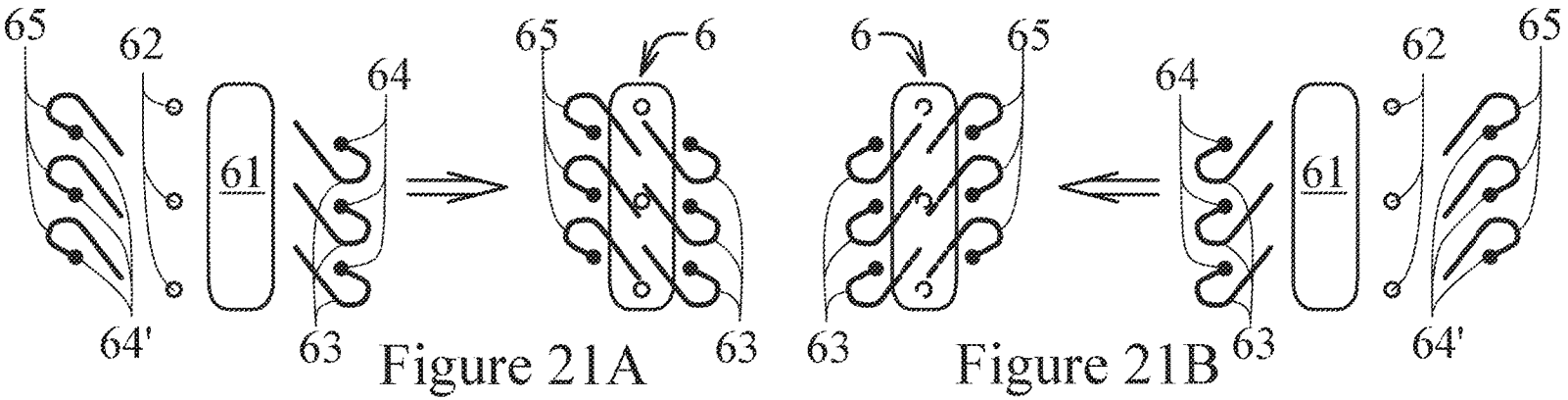
Figure 21A
Figure 21B
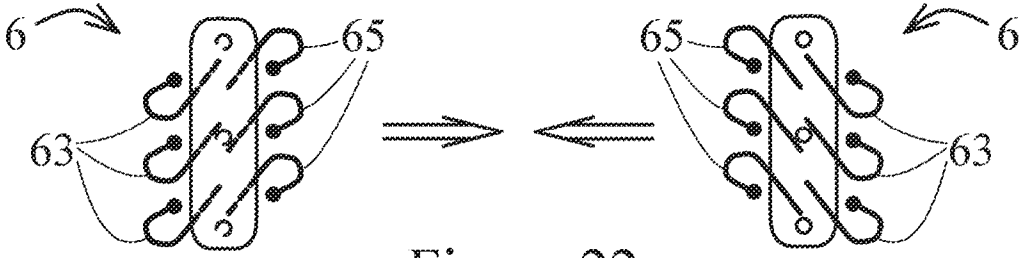
Figure 22
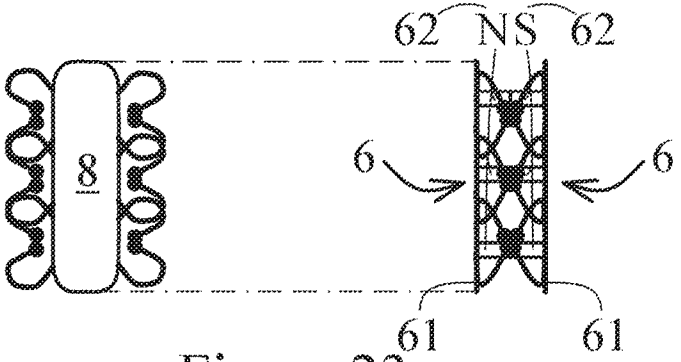
Figure 23

DEVICE, SYSTEM AND METHODS OF USE AND PRODUCTION FOR PREVENTING CHAINS OF A PLURALITY OF NECKLACES SIMULTANEOUSLY WORN BY A USER FROM ENTANGLING

BACKGROUND OF THE INVENTION

It is not uncommon for individuals who wear necklaces, to sometimes wear more than one necklace at the same time. Yet, at illustrated by FIG. 1 which for example, not limitation, show three necklaces being worn at once, it is often the case that the necklace chains 1 will become entangled with one another while they are worn by a user. A section of the neck and shoulders of such a user with entangled necklace chains 1 is illustrated from a front view by the mannequin figurine 11. It would be desirable to have a simple-to-use, effective device, system and method which can be used to prevent such entangling, and to have a simple method for producing this device.

SUMMARY OF THE INVENTION

Disclosed herein is a necklace chain entangling preventer apparatus for preventing necklace chains of a plurality of N greater than 1 necklaces from entangling when simultaneously worn by a user thereof, the apparatus comprising a first entangling preventer half and a second entangling preventer half, each the entangling preventer half comprising: a substantially flat rigid body plate; a plate-half attachment facilitator permanently affixed to the body plate for attaching the first entangling preventer half with the second entangling preventer half; a plurality of N substantially rigid necklace chain threading hooks permanently affixed to the body plate with a necklace chain threading separation between ends of the necklace chain threading hooks and the body plate, each the hook and separation configured for enabling the necklace chain of one of the N necklaces to be threaded into an interior region substantially circumscribed by the hook by passing the necklace chain through the separation and into the interior region without utilizing end-clasping hardware of the necklaces; the plate-half attachment facilitators affixed to their respective rigid body plates with opposite mating configurations; except for the plate-half attachment facilitators being affixed to their respective rigid body plates with opposite mating configurations, the two entangling preventer halves being otherwise substantially identical; the necklace chain threading hooks positioned to vertically separate the N necklace chains from one another when the N necklaces have been threaded therethrough and the two entangling preventer halves have been attached to one another behind the user's neck using the attachment facilitators; and a plurality of N necklace chain threading retainers, selected from the necklace retainer group consisting of: a malleable material retainer, a pivot retainer, a pole retainer, and an opposite plate inverted hook passively-engaged retainer.

BRIEF DESCRIPTION OF THE DRAWINGS

The features of the invention believed to be novel are set forth in the appended claims. The invention, however, together with further objects and advantages thereof, may best be understood by reference to the following description taken in conjunction with the accompanying drawing(s) summarized below.

FIG. 2 is a prior art illustration of an exemplary fine or costume jewelry necklace with a traditional cable chain.

FIG. 3 is a prior art illustration of an exemplary fine or costume jewelry necklace with an adjustable cable chain.

FIGS. 4A, 4B and 4C review the way in which the two ends of a fine or costume jewelry necklace with a traditional chain are typically attached together in the prior art.

FIGS. 5A, 5B and 5C review the way in which the two ends of a fine or costume jewelry necklace with adjustable cable chain are typically attached together in the prior art.

FIGS. 6A and 6B contain plan views illustrating the basic components of the necklace entangling preventer apparatus from both left- and right-handed views, both prior to their fabrication, and once they have been fabricated and are ready for use by a user. This includes a first alternative preferred "malleable material retainer" embodiment of the invention.

FIG. 7 is a plan view illustrating how each of two necklace chain entangling preventer halves of the invention embodiment of FIGS. 6A and 6B are attached together in accordance with the method of using the invention.

FIG. 8 is a plan view illustrating each of two necklace chain entangling preventer halves of the invention after they have been attached together, on the left from a front plan view, and on the right from a side plan view.

FIGS. 15A and 15B contain plan views illustrating a second alternative preferred "pivot retainer" embodiment of the invention.

FIG. 16 is a plan view illustrating how each of two necklace chain entangling preventer halves of FIGS. 15A and 15B are attached together in accordance with the method of using the invention.

FIG. 17 is a plan view illustrating each of two necklace chain entangling preventer halves of FIGS. 15A and 15B after they have been attached together, on the left from a front plan view, and on the right from a side plan view.

FIGS. 18A and 18B contain plan views illustrating a third alternative preferred "pole retainer" embodiment of the invention.

FIG. 19 is a plan view illustrating how each of two necklace chain entangling preventer halves of FIGS. 18A and 18B are attached together in accordance with the method of using the invention.

FIG. 20 is a plan view illustrating each of two necklace chain entangling preventer halves of FIGS. 18A and 18B after they have been attached together, on the left from a front plan view, and on the right from a side plan view.

FIGS. 21A and 21B contain plan views illustrating a fourth alternative preferred "opposite plate inverted hook passively-engaged" embodiment of the invention.

FIG. 22 is a plan view illustrating how each of two necklace chain entangling preventer halves of FIGS. 21A and 21B are attached together in accordance with the method of using the invention.

FIG. 23 is a plan view illustrating each of two necklace chain entangling preventer halves of FIGS. 21A and 21B after they have been attached together, on the left from a front plan view, and on the right from a side plan view.

DETAILED DESCRIPTION

Figure 1:
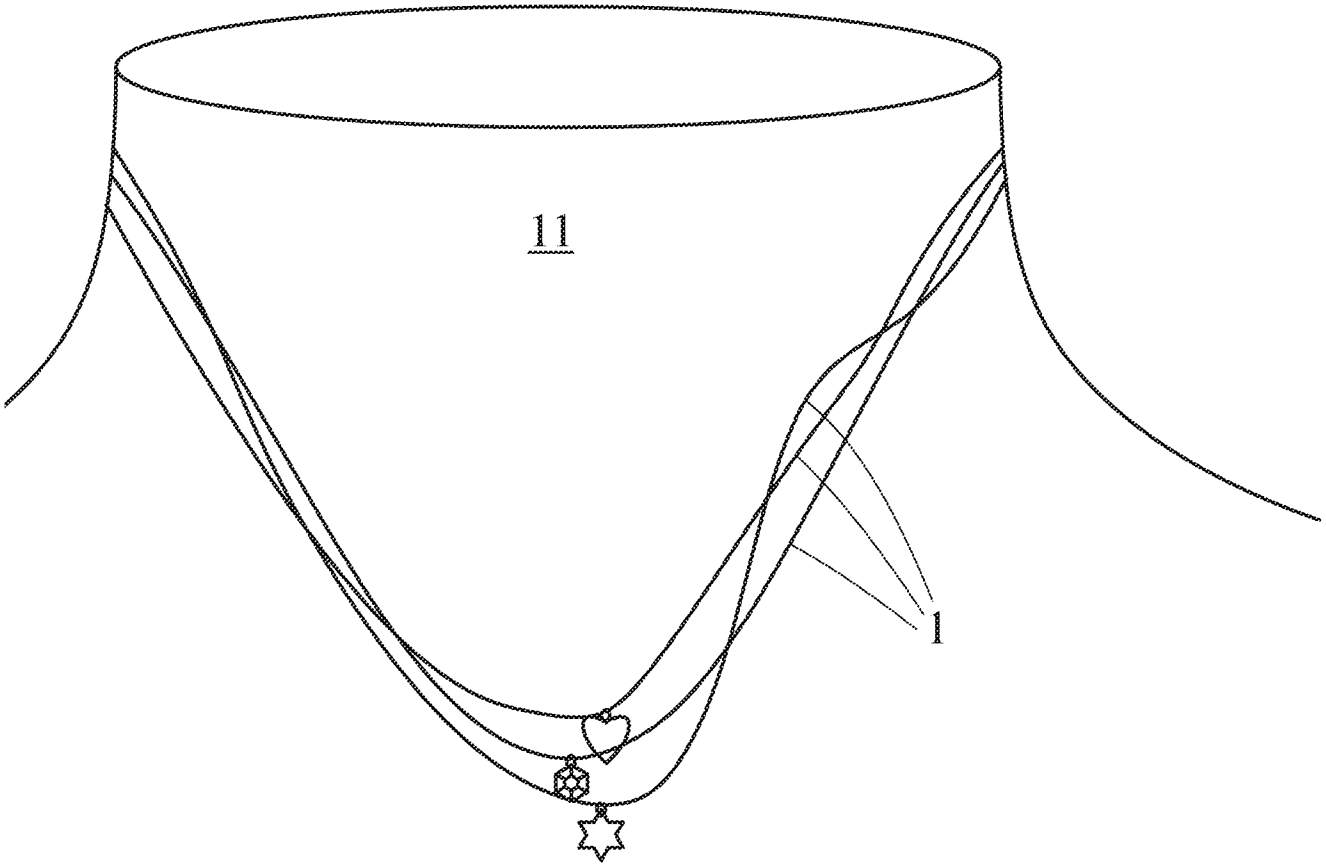
Figure 1 (Prior art)
FIG. 1 is a prior art illustration from a front view of the necklace wearer, schematically showing how necklace chains can become entangled when multiple necklaces are worn about the neck of a wearer without making any provision to prevent their entangling.

Before reviewing a preferred embodiment of the necklace entangling preventer apparatus used to practice this invention, it will be helpful to provide some background regarding necklace chains and the clasp used to attach the ends of necklaces together, as these are commonly used in the prior art.

As illustrated in FIGS. 2 and 3, generally there are two types of necklace chains 1 used in the prior art to attach the ends of a necklace together. For what is considered "fine jewelry or costume traditional cable chain," as illustrated in FIG. 2, the necklace chain 1 is generally very thin from one end to the other, comprising a large plurality of interlinked loops in series as shown, measuring no more than 1/16" in diameter for female necklaces, though sometimes substantially larger for male necklaces. At a first end of the chain 1 is an attachment loop 21 as shown, which is typically no greater than 1/4" in diameter. At the opposite, second end of the chain is a clasp 22 also as shown which is actuated by a clasping apparatus 23 often colloquially referred to as a "lobster claw," also typically under 1/4" in diameter. The connection formed using these components will be further reviewed in FIG. 4. A necklace display piece 24 is typically located proximate the center of the chain 1.

As illustrated in FIG. 3, for fine or costume jewelry with an adjustable cable chain the primary body of the chain 1 is still of the thin character just described, of generally less than 1/4" in diameter for females and perhaps thicker for males. But, the first end of the chain 1 typically contains a series of larger attachment loops 21 of no greater than 1/4" in diameter, any of which can be attached to the clasp 22. This of course, enables the user to choose which loop 21 to attach to the clasp 22 to hang the necklace, in such a way as to vary how far down the display piece 24 will hang in front of the user's upper torso. This succession of attachment loops 21, differs from the fine or costume jewelry traditional cable chain illustrated by FIG. 2 because the fine or costume jewelry traditional cable chain is generally pre-fitted as regards to its length to the particular user who will be wearing that necklace. As an example, without limitation, the fine or costume jewelry traditional cable chains of FIG. 2 are commonly available in 16", 18", and 20" fabricated lengths.

FIG. 4 review the prior art method by which the loop 21 at the first end of the chain 1 is attached to the clasp 22 at the second end using the clasping apparatus 23 often colloquially referred to as a "lobster claw." Initially, with the chain 1 around the user's neck, an actuator 41 of the clasping apparatus 23 at the second end of the chain 1 is pulled back as illustrated by the small arrow in FIG. 4A, into the position shown in FIG. 4B. Within the clasping apparatus 23, this actuator 41 is connected to a retractable loop section 42 which simultaneously moves along the other small arrow in FIG. 4A to create an attachment opening 43. The actuator 41 is also typically connected to a spring-like mechanism inside the clasping apparatus 23 which causes the actuator 41 and the retractable loop section 42 to default to the position of FIGS. 4A and 4C when the user is not applying pressure to pull back the actuator 24.

With the actuator 41 pulled back, the user then takes the loop 21 at the first end of the chain 1 and loops this through the attachment opening 43 onto the clasp 22 to reach the configuration of FIG. 4B. Then, the user releases the actuator 41, the retractable loop section 42 springs back to its closed default position, and the two ends of the necklace chain 1 are now attached together with the necklace now hanging from the user's neck.

FIG. 5 illustrate the process for attaching together the two ends of a fine or costume jewelry necklace with an adjustable cable chain. This process is exactly the same was what was just reviewed with FIG. 4, but for the fact that the user can choose any one of the series of attachment loops 21 on the first end of the necklace, to attach to the clasp 22 on the second end. If any attachment loop 21 other than the one on the very end is chosen, then some loops will hang down, as also illustrated in FIGS. 5B and 5C.

FIGS. 6 through 8 now illustrate a necklace entangling preventer apparatus in a preferred embodiment of the invention, and its method of production. Although this preferred embodiment is configured to allow the simultaneous wearing of three necklaces without tangling, this does not limit the scope of this disclosure or its associated claims as regards producing and using a like-apparatus which operates on the same inventive principle but accommodates four or more necklaces. Nor does it limit producing and using a like-apparatus for two necklaces, or using the preferred embodiment disclosed here, but with only two necklaces.

During testing of prototypes, so as to avoid unwarranted downward drag on the backs of necklaces attached thereto, it was found that the total optimal weight of device is 2.5 to 3 grams, though this mention of optimum weight is non-limiting as regards the associated claims. In general, the optimization of device weight requires the device to be lighter than the total weight of the necklaces to be hung from the device, which in turn depends upon how many necklaces are hung as well as the total weight of those necklaces. As a good rule of thumb based on what can be anticipated about typical weights of necklaces to be hung, a preferred maximum total weight for the device would be about 6.5 grams on the low end, to about 10 grams on the high end.

FIGS. 6A and 6B illustrate the basic components of the necklace entangling preventer apparatus in a preferred embodiment, from both left- and right-handed views, both prior to their fabrication and once they have been fabricated and are ready for use by a necklace wearer. The necklace entangling preventer apparatus of the invention comprises two entangling preventer halves 6. These entangling preventer halves 6 are fabricated to be completely identical to one another except for the mating configurations of their plate-half attachment facilitators 62. But as will be discussed, when these two entangling preventer halves 6 are used, they are oriented in opposite directions from one another and then mated after necklace chains 1 have been inserted through them in a manner that will later be described.

Referring to FIG. 6A, and to FIG. 6B which is identical to FIG. 6A but for its presenting an oppositely oriented view, each of the entangling preventer halves 6 is fabricated comprising four main elements. First, the main body of each of the entangling preventer halves 6 comprises a simple substantially flat, rigid body plate 61 which may be fabricated from any metal, steel, plastic, or other desired substance, for example not limitation, wood, precious stones, or non-precious stones. Each body plate 61 is preferably about ¼" in width, but may be as large as ½" or more. For the three-necklace embodiment being illustrated here, the height of each plate is preferably about 1⅜", but may be as small as 1" and as large as 2". For more necklaces than three, the heights will be scaled up accordingly, but the widths need not be changed.

Second, permanently affixed directly onto each body plate 61 is a plate-half attachment facilitator 62 which in the preferred embodiment comprises a plurality of small cylindrical permanent magnets which can be seen from their side view on the right-hand side of FIG. 8. These cylindrical permanent magnets are preferably about ⅛" in length along the cylindrical axis, and are under ⅛" in diameter. This, however, is non-limiting as to magnet size or shape. It is preferable, but not required, to use neodymium magnets, which are amongst the most powerful fixed magnets known. One may also employ permanent plate magnets (again, preferably neodymium) covering most of the surface of the body plates 61, but experimental prototype testing has demonstrated that the plurality of small cylindrical permanent magnets provides better magnetic adherence of the two entangling preventer halves 6 to one another, which is important to the optimum performance of the invention. And using a plurality of small cylindrical permanent magnets also optimizes space for the other components which must also be attached to the body plates 61, and for the necklaces themselves. Again, while preferred, the foregoing is non-limiting as to magnet size or shape.

Importantly, although FIG. 6A and FIG. 6B are visually identical, there is one important fabrication difference. Consider the preferred embodiment where the plate-half attachment facilitators 62 are magnets: Because firmly adhering the two entangling preventer halves 6 together is essential to the effective use of the invention, the magnets must be affixed to the two body plates 61 with their poles oppositely-oriented, and more generally, they must be affixed to the two body plates 61 with opposite mating configurations. Thus, as will be seen for example in the right-hand part of FIG. 8, the north poles of the magnets on the left plate 61 are adhered to the south poles of the magnets on the right plate 61, which means that the south poles of the magnets must be permanently affixed to the left plate 61 while the north poles of the magnets must be permanently affixed to the right plate 61. It will also be appreciated that this can be varied as amongst the five (5) illustrated magnet pairs. For instance, the top magnet pair can have the configuration illustrated, then the next one down can have the poles inverted, with continued alternation from top to bottom.

Likewise, the use of five (5) magnet pairs used for illustration in this disclosure is non-limiting. There may be as few as one magnet pair in the event less-preferred plate magnets are used, and as few as two pairs if cylindrical magnets are used. Also, as will be seen when we progress to FIGS. 9 through 12 showing the use of the invention, the cylindrical magnets, if used, can be fixed into positions on the plates 61 such that the magnets also serve the utilitarian purpose of preventing one chain 1 and/or clasp 23 and associated end-clasping hardware detailed in FIGS. 3 and 4 from conjoining or entangling with others.

Third, also permanently affixed directly onto each body plate 61 are three substantially rigid necklace chain threading hooks 63, with the choice of three such necklace chain threading hooks 63 corresponding to the apparatus being fabricated to enable wearing three necklaces at the same time. For a different number of necklaces, there will be a different number of such necklace chain threading hooks 63. Optionally affixed to the end of each necklace chain hook 63 is a retention bead 64 help to better retain the necklace chains 1 once these have been properly threaded through the entangling preventer halves 6 in the manner which will be discussed shortly, and also to avert the user accidentally hurting a finger by contact with which might otherwise be with a sharp end of the necklace chain hook 63. Additionally, while these retention beads 64 appended to the ends of the necklace chain threading hooks 63 are not limited in shape or size, they do need to be sized in proportion to necklace chain threading retainer 65 in order to provide sufficient spacing for the proper threading of the necklace chains 1, as will be further reviewed.

Provided between the edge of each body plate 61 and the ends of its necklace chain threading hooks 63, is a small necklace chain threading separation 66. This separation is just large enough for threading the primary body of a necklace chain 1 therethrough. So, given that the primary bodies of necklace chains are typically ¼" of less in diameter, the chain threading separation 66 is approximately ¼". For the preferred embodiment where the plate-half attachment facilitators 62 do comprise a plurality of cylindrical permanent magnets, the necklace chain threading hooks 63 are affixed to the body plates 61 in the spaces between the magnets, so that all of the components affixed to the body plates 61 will not easily detach. These necklace chain threading hooks 63 comprise a thick sturdy wire, such as, but without limitation, a 20, 21 or 22-gauge "fish hook" wire.

Fourth and finally, also permanently affixed directly onto each body plate 61 to extend over a side of each of the three necklace chain threading hooks 63 are three corresponding necklace chain threading retainers 65, as illustrated. Here too, the use of three such necklace chain threading retainers 65 corresponds to the simultaneous wearing of three necklaces, and this too would be changed for a device to accommodate some other number of necklaces. These necklace chain threading retainers 65 comprise a wire that is somewhat thinner and more malleable than the necklace chain threading hooks 63, for example not limitation, a 22-gauge wire or higher, to provide suitable malleability. Yet, this wire should also be sufficiently rigid to enable the retainer 65 to be pressed against its corresponding necklace chain threading hooks 63 to retain the corresponding necklace chains 1 threaded through the hook 63 while the hooks 63 are slid over their corresponding necklace chains 1 in the manner to be described with FIGS. 9 through 12. From the view of the assembled entangling preventer half 6 shown in FIG. 6A, the necklace chain threading retainers 65 are over, i.e., in front of, the necklace chain threading hooks 63. From the view of the assembled entangling preventer half 6 shown in FIG. 6B, the necklace chain threading retainers 65 are behind the necklace chain threading hooks 63. So in either case, the necklace chain threading hooks 63 are affixed closer to the plane of the body plate 61 than are the necklace chain threading retainers 65.

To the right of the arrow in FIG. 6A and to the left of the arrow in FIG. 6B, unnumbered to avoid drawing clutter, we see all of these plate-half attachment facilitators 62 (preferably permanent magnets), necklace chain threading hooks 63, optional retention beads 64 and necklace chain threading retainers 65 affixed to the body plates 61 to form the assembled totality of each entangling preventer half 6. To the left of the arrow in FIG. 6A and the right of the arrow in FIG. 6B we see each of these individual components suitably numbered. It will be noted that from the view of FIG. 6A the plate-half attachment facilitators 62, the necklace chain threading hooks 63 and the necklace chain threading retainers 65 can all be seen in their entirety. And because each of the entangling preventer halves 6 are visually identical (but with a reversal of mating orientation e.g. magnetic polarities as has been pointed out), it will be noted that from the view of FIG. 6B, with the entangling preventer half 6 turned over to an opposite orientation, and as illustrated by hidden lines, the plate-half attachment facilitators 62 are entirely hidden from view, while portions of the necklace chain threading hooks 63 and the necklace chain threading retainers 65 are also hidden from view, behind the body plate 61.

It should be stated that because both of the entangling preventer halves 6 are identical aside from the polarity orientations of the magnets, and are merely flipped over as between FIGS. 6A and 6B, it is regarded to be within the scope of this disclosure and the associated claims to fabricate and use entangling preventer halves 6 with parity opposite to that is illustrated here. In such a situation, some of the lines visible in FIG. 6A would be hidden, while the hidden lines in FIG. 6B would become visible.

Now we turn to FIGS. 7 and 8 which illustrate how each of the necklace chain entangling preventer halves 6 are attached together in accordance with the method of using the invention to prevent necklace chains 1 from becoming tangled. These two FIGS. 7 and 8 show the apparatus without the necklace chains 1 having yet been threaded. That method will be detailed starting with FIG. 9.

Figure 9:
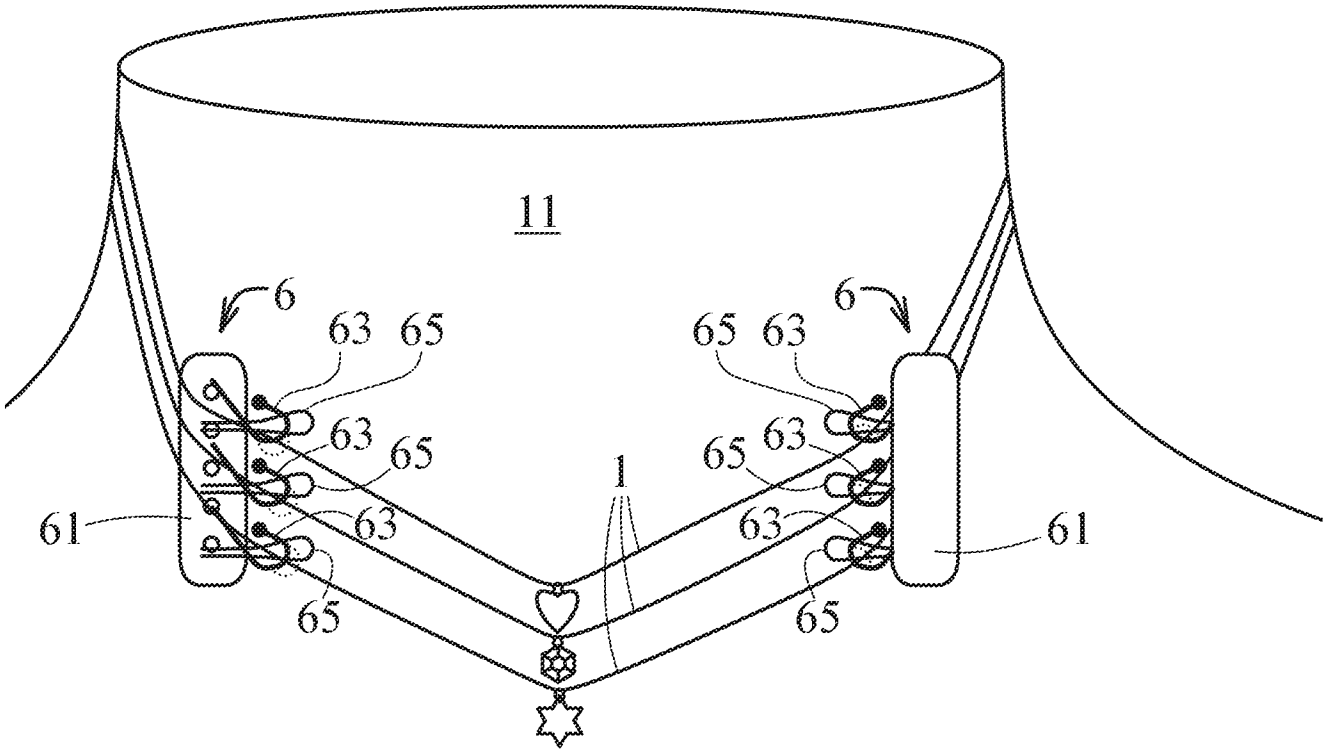
FIG. 9 is a plan view illustrating the start of the method of using the invention to prevent necklace entangling, with the two necklace chain entangling preventer halves situated in front of a user's upper torso and the necklace chains threaded therethrough.

First, starting with the relative orientations shown in FIG. 6 and the entangling preventer halves 6 situated in front of the user's upper torso proximate the necklaces, the necklace chains 1 are threaded into the two entangling preventer halves 6 in a manner that will be detailed starting at FIG. 9. Then, with the necklace chains 1 so-threaded, the entangling preventer halves 6 are moved around to the back of the user's neck. It will be appreciated that if the relative orientation in front of the user is that of FIG. 6, then the relative orientation once these are drawn behind the user will be that of FIG. 7, as view from behind the user. To see this correspondence, it is helpful to compare FIG. 6 (unthreaded) with FIG. 9 (threaded), FIG. 7 (unthreaded) with FIG. 10 (threaded), and FIG. 8 (unthreaded) with FIG. 11 (threaded).

So, the entangling preventer halves 6 with the orientation of FIG. 6 in front of the user attain the orientation of FIG. 7 when moved behind the user. Then, as illustrated by the inward arrows in FIG. 7, the entangling preventer half 6 on the right side of FIG. 7 is moved behind the entangling preventer half 6 on the left side of FIG. 7, and the plate-half attachment facilitators 62, assuming they are permanent magnets as is preferred, are brought into proximity with opposite poles approaching one another until the magnetic fields snap the magnets and thus the entangling preventer halves 6 together to form the entire necklace entangling preventer apparatus 8 of the preferred embodiment, as shown on the left side of FIG. 8.

Indeed, another benefit of using magnets is that the magnetic fields naturally snap into proper alignment and attachment. This helps to avoid manual fumbling by the user behind the back of the user's neck, which fumbling could otherwise occur with attachment facilitators 62 that do not "seek each other out" in the manner of magnets but instead require the user to press together decidedly-less-preferred other attachment device alternatives such as sliders, Velcro, Ziploc, snaps, buttons, hooks and clasps.

From the right-side view on the right side of FIG. 8, the plate-half attachment facilitators 62 (preferably magnets) are seen attached to one another via the magnetic fields from the opposite N and S poles, thereby attaching together the two entangling preventer halves 6 including their body plates 61 (numbered), and their necklace chain threading hooks 63, optional retention beads 64 and necklace chain threading retainers 65 (not numbered to avoid clutter). If permanent cylindrical magnets are used as is preferred, and if these are about ⅛" in length 1 along the cylindrical axis and under ⅛" in width w (e.g. diameter) as is also preferred and as has been previously mentioned, then the distance between the two body plates 61 from the side view in FIG. 8 will be 2l, about ¼". This, in combination with the spacing between magnets, creates sufficient space for portions of the necklace chains 1 and the attachment hardware of FIGS. 4 and 5 to situate once they have been threaded into the necklace entangling preventer apparatus 8 and that apparatus has been deployed into the configuration of FIG. 8 with the two entangling preventer halves 6 attached to one another.

With FIG. 9, which is taken from a front view of the upper torso 11 of a user, we begin to describe the method of using the necklace entangling preventer apparatus 8 to prevent a plurality of necklace chains 1 from entangling when worn simultaneously. To begin, the user places the necklaces about her or his neck then connects each end of each necklace together in the customary way, using the attachment loops 21, clasps 22 and clasping apparatuses 23 reviewed in FIGS. 1 through 4. Then, the user takes two entangling preventer halves 6 which are identical in all respects except for the polarities of the magnets assuming these are used as the plate-half attachment facilitator 62, and orients the preventer halves 6 oppositely, with the necklace chain threading hooks 63 and the necklace chain threading retainers 65 facing inwards toward one another. This relative orientation is seen without the necklaces in FIG. 6 and with the necklaces in FIG. 9.

Next, the user threads the necklace chains 1 through the chain threading separations 66 (see FIG. 6) and then rests these chains 1 atop the lower portions of the necklace chain threading hooks 63 as illustrated. Specifically, for the entangling preventer half 6 on the user's left-hand side (to the right of FIG. 9), each chain, from the front view of FIG. 9, is placed behind the plate 61, then threaded through its chain threading separation 66 (again see FIG. 6), then rested atop the lower portion of its necklace chain hook 63, within the interior region substantially circumscribed by its hook 63. Importantly, this is achieved without utilizing the end-clasping hardware 21, 22, 23 of the necklaces. Each necklace chain threading retainer 65 is then pressed against the necklace chain hook 63 so as to retain its corresponding necklace chain 1 in place. This means that for the entangling preventer half 6 to the right of FIG. 9, from the front view of FIG. 9, the threadings of the necklace chains 1 will be in front of the necklace chain threading retainers 65, which is illustrated by the faint dotted semicircles above the intersections of the chains 1 and the necklace chain threading hooks 63.

Conversely, for the entangling preventer half 6 on the user's right-hand side (to the left of FIG. 9), each chain, from the front view of FIG. 9, is placed in front of the plate 61, then threaded through its chain threading separation 66 (again see FIG. 6), then rested atop the lower portion of its necklace chain hook 63. Each necklace chain threading retainer 65 is then pressed against the necklace chain hook 63 so as to retain its corresponding necklace chain 1 in place. This means that for the entangling preventer half 6 to the left of FIG. 6, from the front view of FIG. 6, the threadings of the necklace chains 1 will be behind the necklace chain threading retainers 65, which is illustrated by the faint dotted semicircles below the intersections of the chains 1 and the necklace chain threading hooks 63. It was stated earlier, and is reiterated here, that the entangling preventer halves 6 can be fabricated with a parity entirely opposite two what has been described above, then used with a method also having opposite parity, all within the scope of this disclosure and its associated claims. It is important that a user of this invention learn the threading operation just described. But with a few practice attempts, a user should become adept at threading the necklaces in this fashion.

Figure 10:
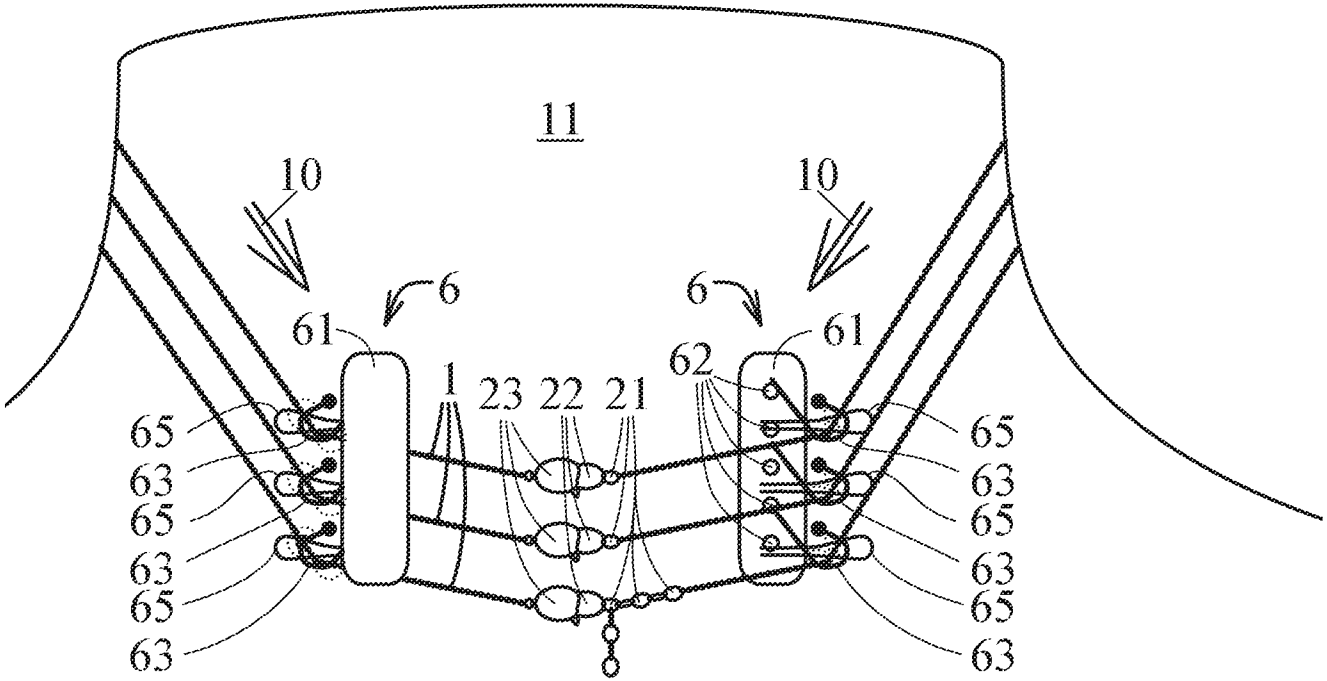
FIG. 10 is a plan view illustrating the continuation of the method of using the invention to prevent necklace entangling, with the two necklace chain entangling preventer halves situated behind the user's neck and the necklace chains continuing to be threaded therethrough in the configuration initiated with FIG. 9.

FIG. 10 illustrates the continuation of the method just reviewed in FIG. 9. It is seen from this rear view of the wearer how the necklaces are attached at their ends in the usual way via the attachment loops 21, clasps 22 and clasping apparatuses 23 reviewed in FIGS. 1 through 4. It will also be seen how in FIG. 10—solely for purposes of illustration and without any limitation—the user has chosen to wear two fine or costume necklaces with "traditional" cable chains in the top two positions, and one fine or costume necklace with an "adjustable" cable chain in the lowest position, with the latter indicated by the several attachment loops 21.

So, starting with the threaded configuration of FIG. 9, and the threading of the necklace chains 1 maintained in the necklace chain threading hooks 63 by the necklace chain threading retainers 65, the user takes each of the entangling preventer halves 6 and simply moves them around his or her neck from front to back in the direction indicted by the arrows 10, while also synchronously rotating each entangling preventer half 6 about its long axis during this moving operation 10. It will be appreciated that when this occurs, the entangling preventer half 6 which was on the left side of FIG. 9 has now moved to the right side of FIG. 10 and also to the right side of the wearer's body, and the entangling preventer half 6 which was on the right side of FIG. 9 has now moved to the left side of FIG. 10 and also to the left side of the wearer's body. And it will also be appreciated how as a result of this moving 10, the necklace chain threading hooks 63 and the necklace chain threading retainers 65 of the two halves 6 will now be facing outward away from one another as they were in the unthreaded configuration of FIG. 7.

Because the threading is maintained throughout this moving process by the hooks 63 in combination with the retainers 65, the resulting configuration in FIG. 10 finds the chains 1 now hidden behind the entangling preventer half 6 on the left and visible in front of the entangling preventer half 6 on the right. Further, one benefit of the invention is that this moving 10 of the entangling preventer halves 6 from the front to the back of the user while maintaining the threading kneads out any tangles which may have developed amidst the chains 1 and is part of how the invention prevents tangling. The relations of the necklace chains 1 with the necklace chain threading hooks 63 at their points of intersection continue to be illustrated using semicircles above the chain threading hooks 63 to indicate that a chain 1 is in front of the chain threading hooks 63 and semicircles below to indicate that a chain 1 is behind the chain threading hooks 63.

Also, it will be seen how in the configuration of FIG. 10, the plate-half attachment facilitators 62, preferably comprising cylindrical magnets, are visible from the rear view of the entangling preventer half 6 on the right and hidden from the rear view of the entangling preventer half 6 on the left.

Figure 11:
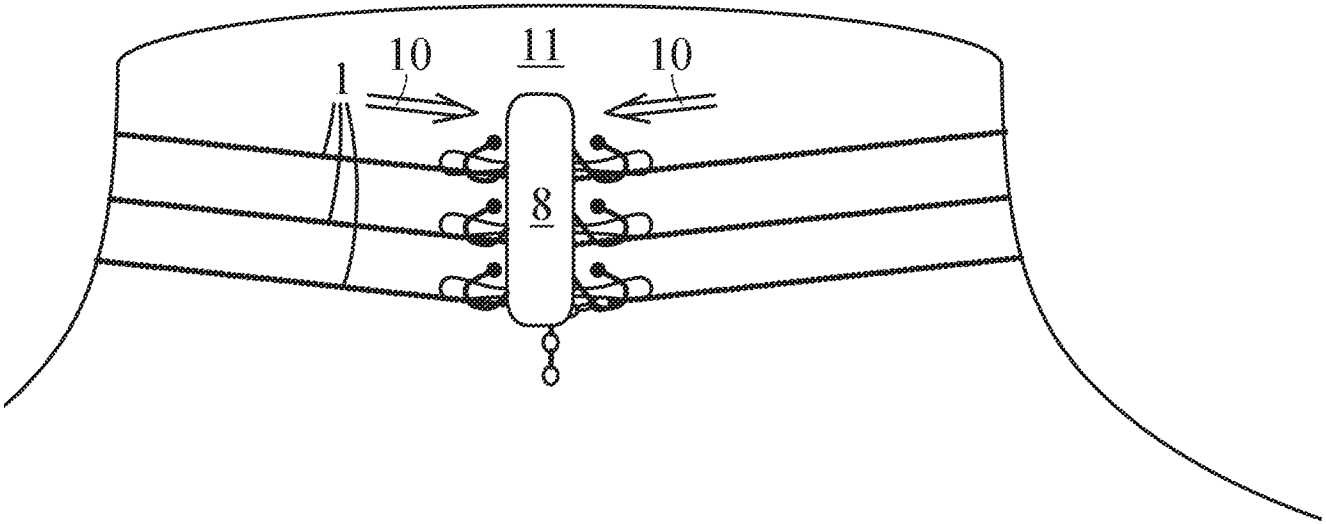
FIG. 11 is a plan view illustrating the completion of the method of using the invention to prevent necklace entangling, with the two necklace chain entangling preventer halves connected to one another behind the user's neck using plate-half attachment facilitators thereof, and the necklace chains continuing to be threaded therethrough in the configuration initiated with FIG. 9 and continued with FIG. 10.

Finally, in FIG. 11 the method of using the invention to prevent necklace entangling is completed by simply continuing to move the two entangling preventer halves 6 toward one another along the lines 10, to then move the right plate behind the left plate as viewed from FIG. 10, and finally bring the plates close enough together that the plate-half attachment facilitators 62, preferably comprising cylindrical magnets, engage one another and snap into attachment. It will be seen that this is the same configuration which as shown on the left side of FIG. 8, but now with the necklaces threaded through the entire necklace entangling preventer apparatus 8. The separation of the two body plates 61 by the elongated cylindrical magnets as seen from the side view in FIG. 8, will be about ¼" if the opposing magnets are ⅛" in length. This, along with the small diameter of the magnets, provides sufficient space for the ends of the chains 1 and their attachment loops 21, clasps 22 and clasping apparatuses 23 (collectively, necklace end-clasping hardware) shown at the center of FIG. 10, to become fully or substantially hidden from view between the two body plates 61 once the two entangling preventer halves 6 have been joined together. Moreover, as previously mentioned, if the number of magnets and the manufactured positioning of the magnets on the plates 61 as attachment facilitators 62 is judiciously chosen, then the magnets can serve the dual, simultaneous function of providing additional separation barriers between adjacent chains 1 and their end-clasping hardware 22, 23, 24.

Figure 12:
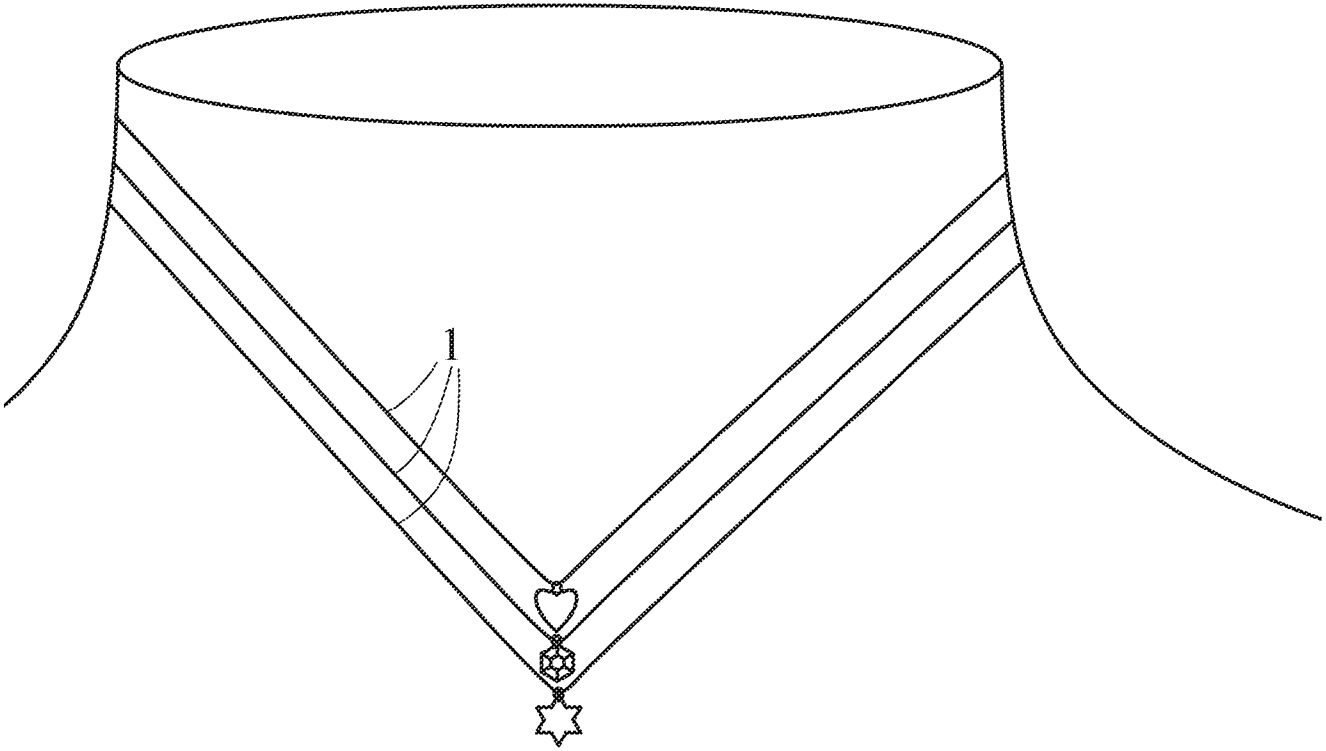
FIG. 12 is an illustration from a front view of the necklace wearer, of how necklace chains are prevented from entangling when multiple necklaces are worn about the neck of that wearer, by virtue of the invention being situated behind the wearer's neck as illustrated in FIG. 11.

With this configuration achieved, the user moves the necklace entangling preventer apparatus 8 to an elevated position behind the neck as also seen in FIG. 11. And because a vertical separation behind the neck is enforced by the necklace entangling preventer apparatus 8 amongst the chains 1, the chains 1 will also maintain an untangled configuration when viewed from in front of the wearer, as seen in FIG. 12, which should be contrasted to the entangled FIG. 1.

It will be appreciated that this necklace entangling preventer apparatus 8 is simple in its operational principles and effective in its results. First, it is not necessary to attach the ends of the chains 1 to any separate device, and indeed, these ends are not so-attached to any separate device. The chains 1 are simply placed around the user's neck with their ends attached together in the customary way. Second, the two entangling preventer halves 6 are configured to be threaded with the necklace chains 1 in front of the user while the user is wearing the necklaces. This means that the user can thread the chains 1 not only by feel, but by sight, with the point of control directly in front of the user's face. Third, once properly threaded, there is minimal potential for fumbling in completing the process of use. The user merely moves the entangling preventer halves 6 from the front to the back of the neck while sliding the preventer halves 6 along the already-threaded necklace chains 1. And in the process, any tangles which may have developed among the chains 1 become kneaded out. Fourth, if magnets are employed for the plate-half attachment facilitators 62 as is preferred, the process of attaching the two entangling preventer halves 6 together behind the neck is simple, even though it occurs out of the user's line of sight: The user simply brings the magnets close to one another until the magnetic fields snap them into place. Here too, there is no opportunity for manual fumbling, nor is their any need to engage in the gymnastics of properly aligning then pressing two devices together out of sight behind the user's neck.

It should also be mentioned that although it is highly preferred for the two entangling preventer halves 6 to comprise both the necklace chain threading hooks 63 (configured with their small necklace chain threading separation 66) in combination with the necklace chain threading retainers 65 as the best practice to maintain the threading of the chains 1 while sliding the two halves 6 from the front to the back of the user's neck, it is possible to practice the invention with the necklace chain threading retainers 65 omitted. In this event, one would rely solely on the necklace chain threading hooks 63 to keep the chains 1 retained during this sliding operation. This in turn means that the chain threading separation 66 has to be very close to the diameter of the necklace chain so a chain 1 can be passed therethrough during the threading operation, but conversely does not accidentally slip out through the chain threading separation 66 once it has been threaded into the hooks 63.

With the retainers 65 omitted, if the hooks 63 are fabricated from a sturdy wire material with a small amount of "give," it is possible to fabricate the entangling preventer halves 6 with the separations 66 slightly smaller than the chain 1 diameters, have the hooks 63 "give" when the chains 1 are pressed through the separations 66 during threading, then have the hooks 63 immediately return to their default "memory" positions whereby the separations 66 are again slightly smaller than the diameters of the chains 1 so a chain 1 does not slip out and can only be removed when the user takes active steps to remove it. Given that necklace chain diameters may vary, however, this less-preferred practice of omitting the retainers 65 ties the separations 66 to specific necklace diameters, whereas the use of the retainers 65 allows the separations 66 to be somewhat independent of the chains that a user may use in connection with the invention.

The overall process, especially once it has been practiced a few times by the user, is simple, fast, and foolproof. Once threaded, the front-to-back movement and attachment of the two entangling preventer halves 6 can be carried out in two to three seconds. At that point, with the behind-the-neck positions of the necklace ends having a vertical separation from one another enforced by the necklace entangling preventer apparatus 8, subsequent entangling is prevented.

It will also be apparent that the necklace entangling preventer apparatus 8 is entirely self-contained with all of the components required to prevent necklace chain entangling. There is no need to purchase or adhere additional clasps and or fastening agents to the necklace entangling preventer apparatus 8. The clasps and fastening agents 21, 22, 23 of existing necklaces are used for this purpose in their usual fashion. The device 8 simply provides threading hooks 63 and threading retainers 65 for threading the necklace 1 and maintaining this threading, both while the two halves 6 are moved into their final position and attached 62 behind the user's neck, and thereafter while the user is out and about displaying his or her plurality of necklaces without entanglement.

Because each of the halves 6 is identical in physical form and the only difference between the halves 6 is in opposite polarities required for the magnets (and opposite "mating" components in the event that definitively less-preferred other attachment device alternatives such as sliders, Velcro, Ziploc, snaps, buttons, hooks and clasps are used), the manufacturing of the apparatus of this invention simple: All parts of the two entangling preventer halves 6 can be manufactured in exactly the same way except for the plate-half attachment facilitators 62. Thereafter, the plate-half attachment facilitators 62 are attached with opposed "mating" features, e.g., opposed polarity, male versus female components, etc. So, where the plate-half attachment facilitators 62 on each plate 61 comprise a plurality of permanent magnets, these opposite mating configurations comprise the permanent magnets of 62 affixed to the body plate 61 of the first entangling preventer half 6 being affixed thereto with opposite magnetic polarity orientation relative to the permanent magnets of 62 affixed at corresponding positions to the body plate 61 of the second entangling preventer half 6.

Also, while the plates 61 shown in FIGS. 1 through 12 are utilitarian with no attractive design features added, it is certainly envisioned and understood within the scope of this disclosure and the associated claims, because this device will be worn along with jewelry, that the appearance of the device itself will matter to its users. Thus, the preventer halves 6 and their plates 61 may themselves be fashioned into shapes and forms with attractive visual design features in the nature of a jewelry item, such as hearts diamonds, stars, flowers, etc., and/or may themselves have jewelry stones or findings embedded or attached to them and/or may be etched in attractive ways.

Figure 14:
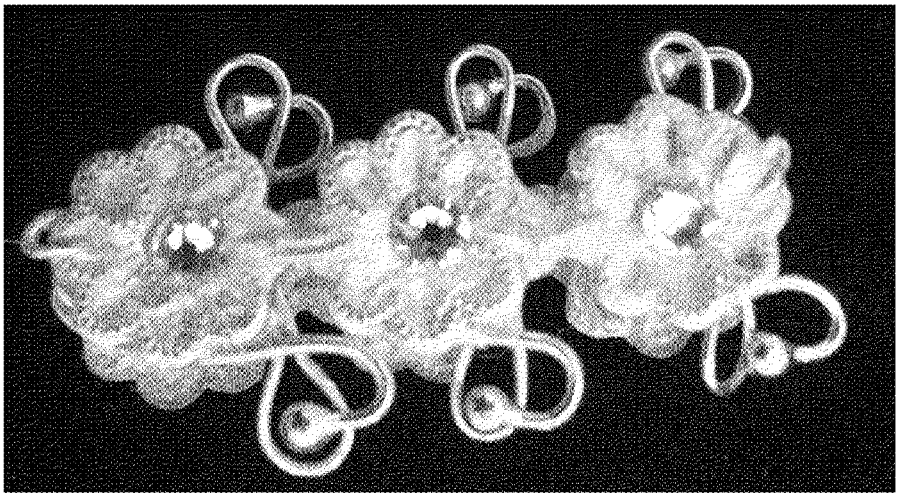
FIG. 14 shows these floral design prototype halves of FIG. 13 mated together as they would appear behind a wearer's neck once the necklaces have been threaded in accordance with the method of using the invention.
Figure 13:
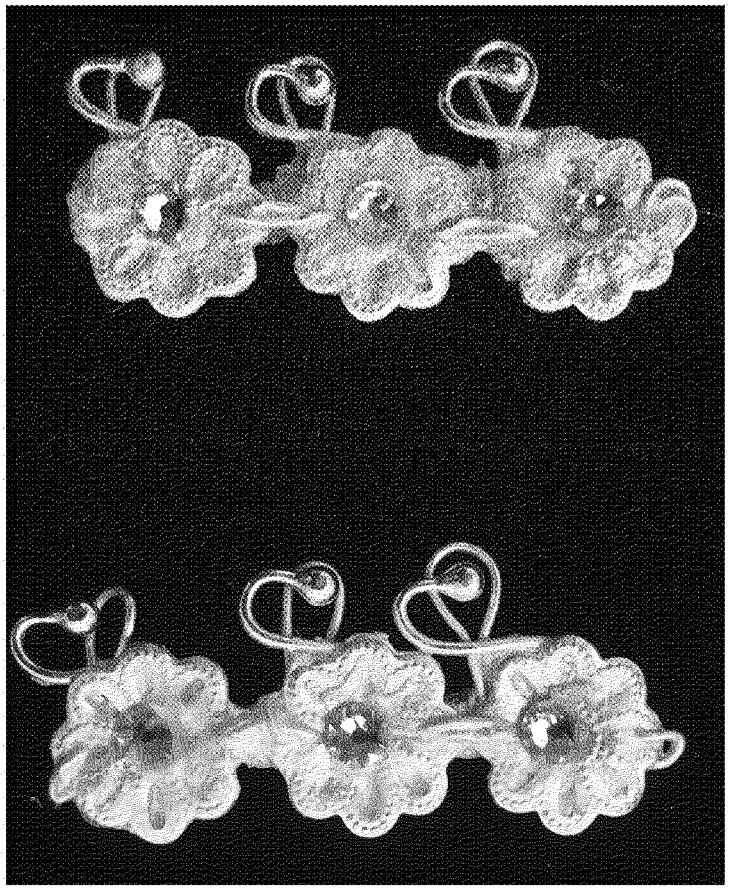
FIG. 13, for example not limitation, is a photograph of an experimental prototype of the "malleable material retainer" invention embodiment of FIGS. 6A and 6B, having a visual design comprising three flowers for each of the two necklace entangling preventer halves.
Figure 25:
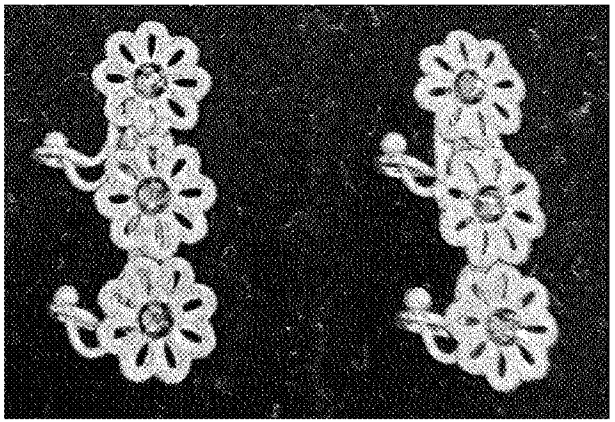
FIG. 25 is a photograph of an experimental prototype of FIG. 24, from a front view.
Figure 26:
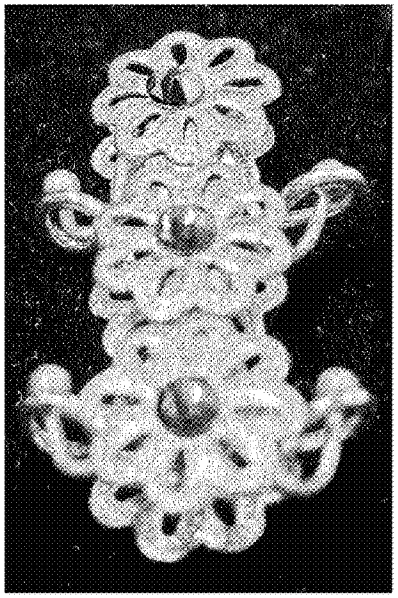
FIG. 26 shows these prototype halves of FIG. 24 mated together as they would appear behind a wearer's neck once the necklaces have been threaded in accordance with the method of using the invention.
Figure 24:
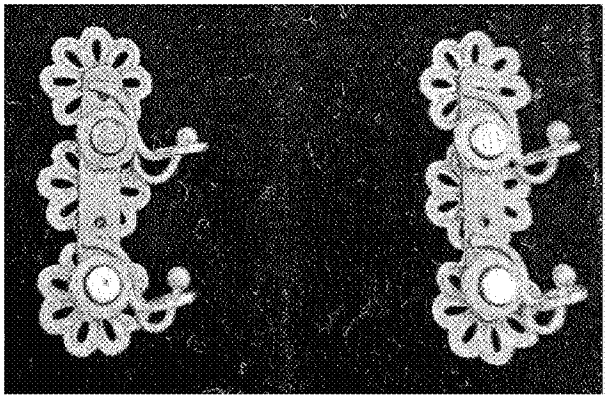
FIG. 24, for example not limitation, is a photograph of an experimental prototype of the pivot retainer invention embodiment of FIGS. 15A and 15B, with retainers pivoted to an engaged position about the hooks, from a rear view, with floral design, for two necklaces.
Figure 29:
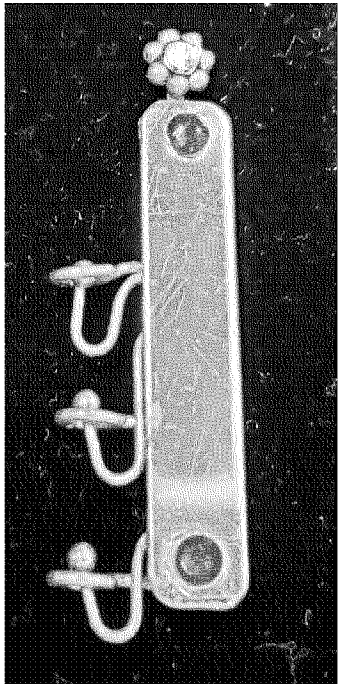
FIG. 29 is a photograph of the prototype of FIG. 28 from a front view.
Figure 28:
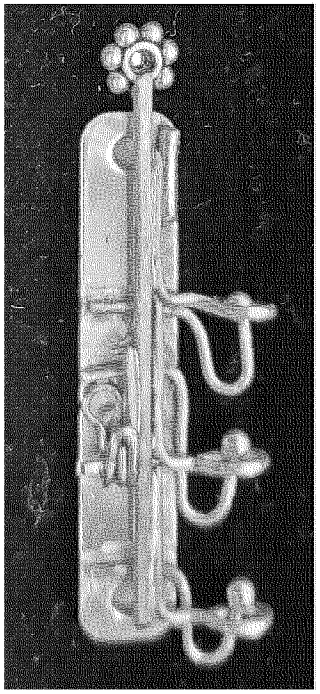
FIG. 28, is a photograph of an experimental prototype of one of the halves of the pole retainer from FIG. 27, with the pole and the plate mated.
Figure 27:
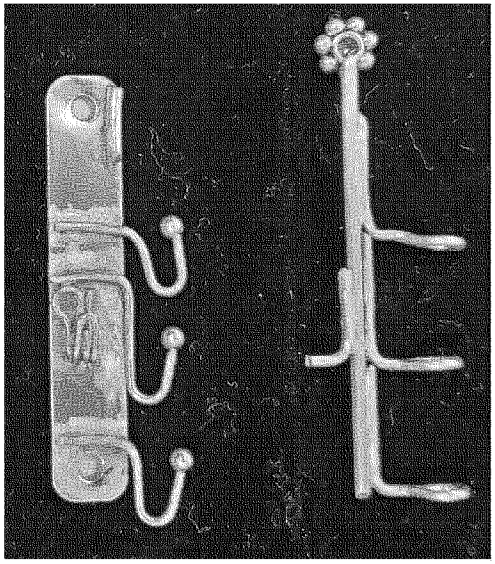
FIG. 27, for example not limitation, is a photograph of an experimental prototype of one of the halves of the pole retainer invention embodiment of FIGS. 18A and 18B, with the plate separate from the pole, from a rear view, with floral design, for three necklaces.
Figure 32:
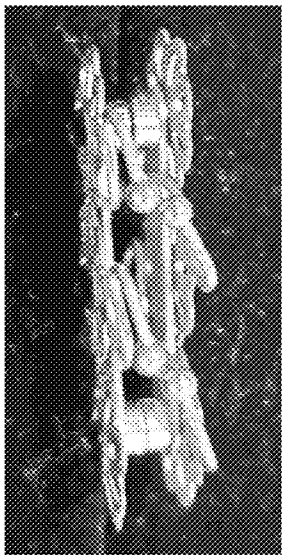
FIG. 32 is a photograph of the prototype of FIG. 31 from a side view.
Figure 31:
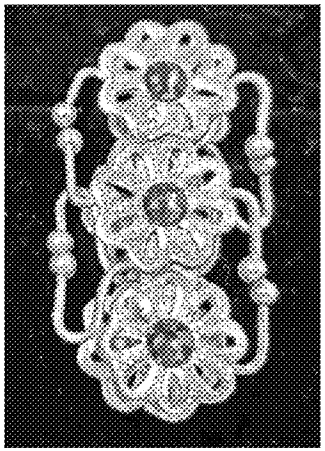
FIG. 31 shows these prototype halves of FIG. 30 mated together as they would appear behind a wearer's neck once the necklaces have been threaded in accordance with the method of using the invention.
Figure 30:
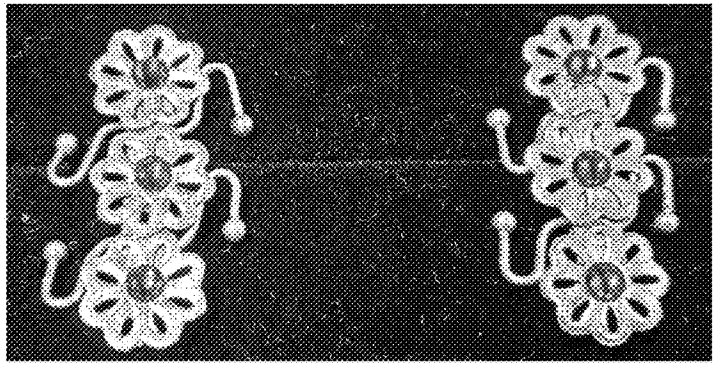
FIG. 30, for example not limitation, is a photograph of an experimental prototype of the opposite plate inverted hook passively-engaged retainer invention embodiment of FIGS. 21A and 21B, with floral design, for two necklaces.

In this regard, FIG. 13, for example not limitation, is a photograph of an experimental prototype of the malleable material retainer embodiment of the invention, having a visual design comprising three flowers for each of the two entangling preventer halves 6, one flower for each necklace to be used in connection with the device, and with a stone embedded in the center of each flower. Note also the visual alignment of each of the three flowers with each of the necklace chain threading hooks 63, optional retention beads 64 and necklace chain threading retainers 65, so as to attractively merge these utilitarian elements 63, 64, 65 into the design. FIG. 14 in turn, shows these halves 6 mated together as they would appear behind a wearer's neck once the necklaces have been threaded.

In the invention embodiment disclosed in connection with FIGS. 6A and 6B, it was stated that the necklace chain threading retainers 65 comprise a wire which is somewhat thinner and more malleable than the necklace chain threading hooks 63. It was later disclosed in connection with FIG. 9 that these malleable necklace chain threading retainers 65 are pressed against the necklace chain hook 63 so as to retain its corresponding necklace chain 1 in place, after which the two entangling preventer halves 6 are moved from the front to the back of the user's neck in the direction indicted by the arrows 10, as disclosed in FIG. 9 through 11, leading to the final usage configuration of FIG. 12. Now, we shall review several additional embodiments for the necklace chain threading retainers 65 in which these retainers 65 are not malleable to any substantial degree, and specifically, in which there is no need to at any point to bend these necklace chain threading retainers 65 in order to secure the necklace chain 1 in place. A benefit of these embodiments, is that they eliminate any danger that a necklace chain threading retainer 65 might break after many uses of the invention owing to its being repeatedly bent.

FIGS. 15A and 15B illustrate a second alternative preferred "pivot retainer" embodiment for the necklace chain threading retainers 65. As illustrated, in contrast to the "malleable retainer" embodiment of FIGS. 6 through 8, each of the necklace chain threading retainers 65 in the FIG. 15A embodiment comprises a pivot loop 152 proximate its far end. Additionally, each of the plate-half attachment facilitators 62 (still preferably small cylindrical permanent magnets) further comprises a pivot neck 151 which is recessed relative to its head, about its circumference. (For example only, only three facilitators 62 e.g. magnets are shown in FIG. 15.) The pivot neck 151 and the pivot loop 152 are configured to mate with one another in a complementary swiveling fashion such that once mated, each necklace chain threading retainer 65 can be pivoted downward along the rotational arrows 153 and over the retention bead 64, so as to circumscribe the necklace chain threading hooks 63.

For purposes of illustration, FIG. 16, which is the counterpart of FIG. 7, shows the top of the three retainers 65 of each of the halves 6 in an elevated position prior to its being pivoted down along the rotational arrows 153, and shows the lower two of the three retainers 65 of each of the halves 6 in a descended position after it has been pivoted down along the rotational arrows 153. The left-side FIG. 17, which is the counterpart of FIG. 8, then shows all of the pivot retainers 65 in descended position, as well as both of the entangling preventer halves 6 mated together via their plate-half attachment facilitators 62. The downward pivoting of the retainers 65 in this embodiment, replaces the "pressing" of the malleable retainers of the FIG. 6 embodiment. Otherwise, the operating principles of the invention remain entirely unchanged.

Specifically, just as in FIG. 9, the two entangling preventer halves 6 are introduced to a position in front of the user's upper torso with the necklace chain threading hooks 63 facing inward. Then, the necklace chains 1 are passed through and onto the hooks 63 through the necklace chain threading separation 66 (not numbered in FIG. 15, but see FIG. 6), just as in FIG. 9. Then, the retainers 65 are pivoted downward, to the down-pivoted configuration of FIG. 17, thereby retaining the chains 1. Finally, the two entangling preventer halves 6 are moved to the back of the user's neck and secured exactly as described in connection with FIGS. 9 through 11, to arrive at the final usage configuration of FIG. 12.

From a manufacturing standpoint, for the embodiment of FIGS. 15 through 17, the entangling preventer halves 6 may be fabricated by simply setting the pivot loops 152 into position, then affixing the plate-half attachment facilitators 62 with pivot necks 151 to the body plates 61 so as to create the complementary mating to enable the swivel/pivot. Alternatively, the plate-half attachment facilitators 62 with pivot necks 151 can be first affixed to the body plates 61, and then the pivot loops 152 can be created by bending/crimping the wire that comprises the necklace chain threading retainers 65 about the pivot necks 151, in a way that enables the complementary swivel.

FIGS. 18A and 18B illustrate a third alternative preferred "pole retainer" embodiment for the necklace chain threading retainers 65. In this embodiment, all of the necklace chain threading retainers 65 are fabricated integrally with and serially along the length of a retaining pole 18, one such pole 18 for each of the two entangling preventer halves 6. Each one of the two retaining poles 18 comprises a pole body 181, a pole latch 182 and an optional pole head 183, as well as all of the retainers 65 serially-disposed along its length, corresponding to the necklace entangling preventer half 6 with which it will be used. So, for example, for the illustrated three-necklace embodiment of the invention, each pole 18 comprises three serially-disposed retainers 65 along its length, as illustrated. Additionally, to be able to use this pole 18 in the manner that will momentarily be described, each body plate 61 comprises a pole latch securing receptacle 184, which is in addition to the plate-half attachment facilitators 62 (e.g. magnets), necklace chain threading hooks 63 and retention beads 64 disposed on the body plate 61 as disclosed for previous embodiments. Each body plate also comprises an optional pole guide and stabilizer 185 used to guide and stabilize the pole 18 in the manner to be momentarily described. In this embodiment, the retaining pole 18 and its aforementioned components, is preferably fabricated as a physically-separate piece from the body plate 61 and its aforementioned components, as can be seen by the inner drawings in FIGS. 18A and 18B.

To engage the chain threading retainers 65 on the poles 18 with the chain threading hooks 63 in order to secure the necklace chains 1 in the manner previously disclosed, one starts from the inner drawings in FIGS. 18A and 18B and moves to the outer drawings in FIG. 19. Specifically, it will be noticed that in the inner drawings of FIG. 18, the retainers 65 are illustrated slightly higher than the retention beads 64 atop the necklace chain threading hooks 63 (all unnumbered to minimize clutter), and the pole latches 182 are likewise illustrated slightly higher than the pole latch securing receptacles 184 (all numbered). Then, proceeding to the outer drawings in FIG. 19, the user moves the retaining poles 18 into the illustrated spatial relation with the body plate 61, with the retainers 65 all slightly elevated above tops of the chain threading hooks 63 and the pole latches 182 likewise slightly elevated above the pole latch securing receptacles 184. If the optional pole guide and stabilizers 185 are included, the retaining pole 18 associated with each body plate 61 is also placed very slightly to the side of the pole guide and stabilizer 185 on that plate 61, toward the center of its plate 61, in contact with that pole guide and stabilizer 185, for example, as illustrated by the leftmost FIG. 19, to help guide the pole 18 toward a proper mate.

From this relative spatial configuration, held in front of the user's upper torso in the manner previously disclosed in FIG. 9, the user threads the necklace chains 1 through the hooks 63. Then to retain the chains 1 in place, the user presses down on the pole heads 183 as indicated by the arrows 191 to descend all the retainers 65 over all the hooks 63 so as to circumscribe the hooks 63 with all the necklace chains 1 inside, and simultaneously descend the pole latches 182 into the pole latch securing receptacles 184 to mate therewith. If the optional pole guide and stabilizers 185 are included, these help to orient the poles 18 in a vertical orientation which necessary to guide proper mating, and to then stabilize the poles 18 against any unwarranted sideways (relative to the drawings) movement after this mating has been completed. Once this mating has been completed, and after the user has also moved the two entangling preventer halves 6 around to the back of the user's neck from the FIG. 9 to the FIG. 10 configuration which as noted flips the left/right view of the two halves 6, the inner drawings in FIG. 19 illustrate the resulting relative configuration of the two entangling preventer halves 6, not showing the chains 1. In view of the foregoing, it will be appreciated that the pole latch securing receptacles 184 should be fabricated with a depth in relation to the latches 182 themselves that is shallow enough to enable the latches 182 to securely "snap" into these receptacles 184, but also deep enough so that the latches 182 can later be "unsnapped" from these receptacles 184. And it will also be appreciated that the optional pole heads 183 serve the function of providing a point of contact for the user to press the poles 18 down to mate with the plate 61 and its components when mounting the necklace chains 1, and later, for the user to grab these heads 183 to unmate the poles 18 from the plate 61 and remove the necklace chains 1. It will also be appreciated that the act of pressing downward along 191 to snap the poles 18 and their retainers 65 in place is identical in function to the act of pivoting the retainers into place along the rotational arrows 153 in FIGS. 15 and 16. Finally, it will be appreciated that the act of securing the retainers 65 into position about the hooks 63 to secure the necklace chains 1 in place, whether for the embodiment of FIGS. 15 through 17 or that of FIGS. 18 through 20, does not require the retainer wires to be bent at all. As stated, this avoids the possibility of the retainers 65 breaking from the stress of repetitive use. And if the optional pole guide and stabilizers 185 are included, the pole 18 remains properly mated while the necklace entangling preventer apparatus 8 is in use.

Then, working from the inner drawings in FIG. 19 which show a view from the back of the user's neck, the user brings the two entangling preventer halves 6 together until the plate-half attachment facilitators 62 (preferably magnets) attract each other and snap the two halves together into the configuration shown on the left side of FIG. 20. This configuration now is functionally equivalent to that of FIGS. 8 and 17. The right side of FIG. 20 presents a side view of this configuration.

FIGS. 21A and 21B illustrate a fourth alternative preferred "opposite plate inverted hook passively-engaged" embodiment for the necklace chain threading retainers 65. In the retainer embodiments previously disclosed, the chain threading retainers 65 corresponding to a set of chain threading hooks 63 on each body plate 61 for one of the two entangling preventer halves 6 were situated on the same plate 61 as the hooks, and also protruded from the plate 61 in the same direction as the hooks 63. In this fourth alternative embodiment, the retainers 65 corresponding to a set of hooks 63 are a) fabricated so as to be substantially identical in size, shape and curvature to the hooks 65, including an optional mating retention bead 64' appended to its end; b) situated on the opposite plate 61 and half 6 from its associated hooks 63; c) integrally mounted on the plate 61 on which they are situated to protrude from that plate 61 in a direction opposite from the hooks 63 on that same plate; and d) mounted on the plate 61 on which they are situated in an "inverted hook" orientation that is inverted relative to the hooks 63 on that plate, with their ends slightly-elevated in relation to the ends of those hooks 63. FIGS. 21A, 21B and 22 clearly illustrate points a), c) and d) above. FIG. 23 clearly illustrates point b) above. A discussion of how this embodiment is used will further clarify all of the foregoing.

As with FIGS. 6, 15 and 18 previously, the outer FIG. 21 show all of the invention components separately, before their fabrication and combination together into the apparatus of the invention, while the inner FIG. 21 show the invention components post-fabrication, in the orientation into which they are placed in front of the user's upper torso to start the chain 1 mounting process. As with FIGS. 6, 15 and 18 previously, these inner FIG. 21 show how the user orients the hooks 63 to face inwards toward one another. Then, just as in all of the earlier embodiments, and as shown in FIG. 9, the user threads all of the necklace chains 1 over their corresponding hooks 63. However, at this point in the use process, the user does not need to do anything more with regard to the retainers 65 which, as the inner FIG. 21 illustrate, are for this embodiment oppositely-protruding and inverted relative to the hooks 63.

Rather, with the necklace chains 1 now threaded over their corresponding hooks 63, as described in relation to FIG. 10, the user proceeds to slide the two entangling preventer halves 6 around to the back of the user's neck, with the now-threaded hooks 63 having naturally turned to face outwards away from one another while the retainers 65 have likewise turned to face inwards toward one another, as illustrated in FIG. 22. Then, following the process step disclosed in relation to FIG. 11, the user brings the two entangling preventer halves 6 close enough so that the plate-half attachment facilitators 62, preferably cylindrical permanent magnets, will cause the two halves 6 to snap together into the overall necklace entangling preventer apparatus 8. FIG. 23 illustrates from both a plan view behind the user's neck, and a side view, the resulting configuration once the two halves 6 have been snapped together.

What distinguishes this "opposite plate inverted hook passively-engaged" embodiment from all of the other embodiments previously disclosed, is that the retainers 65 naturally assume their function of retaining the necklace chains 1 inside the hooks 63 at the very moment that the two entangling preventer halves 6 have been snapped together, simultaneously with this snapping together. Specifically, as seen in FIG. 23, each retainer 65—having its ends fabricated to be slightly-elevated relative to the ends of its corresponding hook 63—snaps into place so as to close off any possibility of its chain 1 coming off of its hook 63, because these ends all meet up so as to provide no space, or not enough space, for such detachment to occur. On the left side of FIG. 23, this is illustrated by the way in which the ends of the hooks 63 butt up to the ends of the retainers 65 which are affixed to the opposite preventer half 6 to close off any space for the chains 1 to fall out, and specifically by the way in which the optional retention beads 64 come into contact with the optional mating retention beads 64'. The side view of this is also shown on the right of FIG. 23.

It will be appreciated from the foregoing that this "opposite plate inverted hook passively-engaged" embodiment simplifies the process of using the apparatus of the invention, because after the user has placed the two entangling preventer halves 6 in front of the user's upper torso and threaded the chains, there is no need for the user to actively do anything else to engage the retainers 65 in their function. Rather, the retainers 65 naturally snap into position at the very same time that the two halves 6 are snapped together behind the user's neck, eliminating the specific step of the user having to actively engage the retainers 65, with the retainers passively engaging instead. Moreover, there no parts need to be bent or moved at all to thread and retain 65 the necklaces 1 through the hooks 63. The simple act of moving the two halves 6 to the back of the user's neck and attaching them together, simultaneously passively retains 65 the chains 1.

It will also be appreciated that this embodiment further simplifies the use of the invention, because the overall assembly in FIG. 23 is entirely symmetric when the necklace entangling preventer apparatus 8 is rotated 180 degrees about any one of its three spatial axes. This means that at the process step illustrated in FIG. 9, the user does not need to be concerned about whether each entangling preventer half 6 is "up" or "down," because up and down are indistinguishable, and because the hooks 63 and the retainers 65 are interchangeable and indistinguishable. All that matters is that the user orient the entangling preventer halves 6 in front of the user's neck so that a set of bottom-oriented hooks 63/retainers 65 is facing inward toward one another as shown in the inner FIG. 21, which automatically assigns the hook 63 function to these hooks 63/retainers 65. The outward-facing top-oriented hooks 63/retainers 65 are then at the same time, automatically assigned the retainer 65 function.

And it will be appreciated that this "opposite plate inverted hook passively-engaged" embodiment simplifies the manufacturing of the invention, because as separate components, the hooks 63 and the retainers 65 are identical pieces. They are simply attached to the plates 61 on opposite sides thereof, with inverted orientations.

Figure 33:
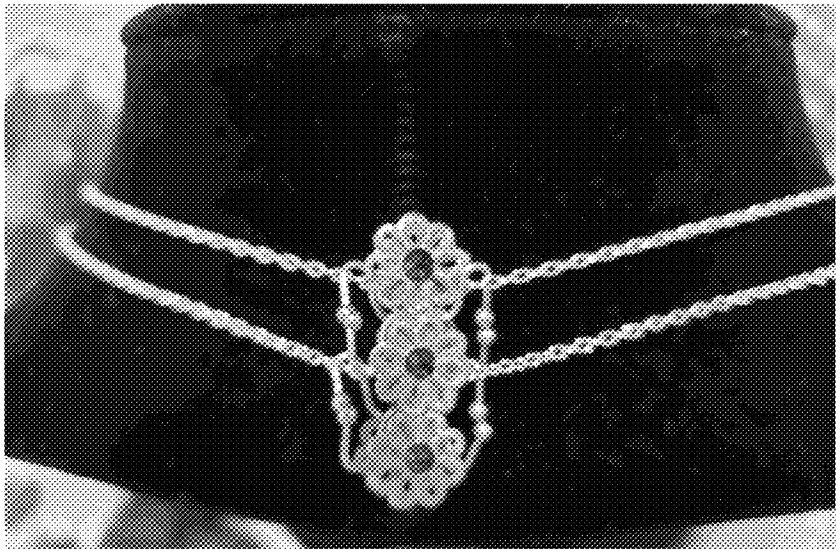
FIG. 33 is a photograph of the prototype of FIGS. 30 through 32 as it appears behind a user's neck, including the threaded chains.

Finally, it will be seen in FIG. 33, which shows this embodiment including the chains 1 after it has been placed around the user's neck, that while the right-side-up hooks 63 can be used to hold up the halves 6 during the threading process, once the halves 6 are joined, the inverted hook retainers 65 that will enable the overall assembly 8 of the invention to hang from the chains 1 while also securing the chains 1 against entangling. This also means that the user, at the user's option, can thread this embodiment either by holding the halves 6 and hanging the chains 1, or by holding the chains 1 and hanging the halves 6.

In addition to all the aforementioned user benefits, this invention should also benefit manufacturers and sellers of necklaces. Once it is known that there is a simple-to-use and highly effective apparatus available for allowing a jewelry aficionado to simultaneously wear a plurality of necklaces without tangling, consumers will be more inclined to purchase two or three or more necklaces at one time, with the plan to have those necklaces grouped together in an assemblage that the consumer will later wear. This has the potential to increase the overall commercial market for necklace sales both in the United States and around the world.

FIGS. 24 through 26, 27 through 29, and 30 through 33 respectively contain photographs of experimental prototypes of the pivot retainer, pole retainer, and opposite plate inverted hook passively-engaged retainer embodiments of the invention, in several views each.

The knowledge possessed by someone of ordinary skill in the art at the time of this disclosure, including but not limited to the prior art disclosed with this application, is understood to be part and parcel of this disclosure and is implicitly incorporated by reference herein, even if in the interest of economy express statements about the specific knowledge understood to be possessed by someone of ordinary skill are omitted from this disclosure. While reference may be made in this disclosure to the invention comprising a combination of a plurality of elements, it is also understood that this invention is regarded to comprise combinations which omit or exclude one or more of such elements, even if this omission or exclusion of an element or elements is not expressly stated herein, unless it is expressly stated herein that an element is essential to applicant's combination and cannot be omitted. It is further understood that the related prior art may include elements from which this invention may be distinguished by negative claim limitations, even without any express statement of such negative limitations herein. It is to be understood, between the positive statements of applicant's invention expressly stated herein, and the prior art and knowledge of the prior art by those of ordinary skill which is incorporated herein even if not expressly reproduced here for reasons of economy, that any and all such negative claim limitations supported by the prior art are also considered to be within the scope of this disclosure and its associated claims, even absent any express statement herein about any particular negative claim limitations.

Finally, while only certain preferred features of the invention have been illustrated and described, many modifications, changes and substitutions will occur to those skilled in the art. It is, therefore, to be understood that the appended claims are intended to cover all such modifications and changes as fall within the true spirit of the invention.

We claim:

1. A necklace chain entangling preventer apparatus for preventing necklace chains of a plurality of $1<N\leq 3$ necklaces from entangling when simultaneously worn by a user thereof, said apparatus comprising a first entangling preventer half and a second entangling preventer half, each said entangling preventer half comprising:

a substantially flat rigid body plate;

a plate-half attachment facilitator permanently affixed to said body plate for attaching said first entangling preventer half with said second entangling preventer half;

a plurality of N substantially rigid necklace chain threading hooks permanently affixed to said body plate with a necklace chain threading separation between ends of said necklace chain threading hooks and said body plate, each said hook and separation configured for enabling the necklace chain of one of the N necklaces to be threaded into an interior region substantially circumscribed by said hook by passing the necklace chain through said separation and into said interior region without utilizing end-clasping hardware of the necklaces, and for enabling each of said entangling preventer halves to be freely slid over said chain thereafter;

said plate-half attachment facilitators affixed to their respective rigid body plates with opposite mating configurations;

except for said plate-half attachment facilitators being affixed to their respective rigid body plates with opposite mating configurations, said two entangling preventer halves being otherwise substantially identical;

said necklace chain threading hooks positioned to vertically separate the N necklace chains from one another when the N necklaces have been threaded therethrough and the two entangling preventer halves have been attached to one another behind the user's neck using said attachment facilitators; and a plurality of N necklace chain threading retainers, selected from the necklace retainer group consisting of: a malleable material retainer, a pivot retainer, a pole retainer, and an opposite plate inverted hook passively-engaged retainer.

2. The apparatus of claim 1, wherein:

each of said N threading retainers comprises said malleable material retainer selected from said necklace retainer group;

each of said N threading retainers corresponds to one of said necklace chain threading hooks on the same entangling preventer half;

each of said N malleable material retainers is configured to extend over a side of corresponding one of said N necklace chain threading hooks, and each of said N malleable material retainers comprises a material with sufficient malleability and rigidity to enable said malleable material retainer to be pressed against its corresponding necklace chain threading hook, for retaining a corresponding already-threaded necklace chain within said interior region of said hook while said retainer is pressed against its said corresponding necklace hook.

3. The apparatus of claim 1, wherein:

each of said N threading retainers comprises said pivot retainer selected from said necklace retainer group;

each of said N threading retainers corresponds to one of said necklace chain threading hooks on the same entangling preventer half;

each of said entangling preventer halves further comprises N pivot necks integrally fabricated therewith;

each of said N pivot retainers is integrally fabricated with a pivot loop proximate an opposite end thereof; and each said pivot loop is configured to pivot down about its corresponding said pivot neck into a position in which said retainer circumscribes its corresponding chain threading hook, for retaining a corresponding already-threaded necklace chain within said interior region of said hook while said retainer circumscribes its said corresponding necklace hook.

4. The apparatus of claim 1, wherein:

each of said N threading retainers comprises said pole retainer selected from said necklace retainer group;

each of said N threading retainers corresponds to one of said necklace chain threading hooks on the same entangling preventer half;

each of said entangling preventer halves further comprises a pole latch securing receptacle;

each of said N necklace chain threading retainers is fabricated integrally with and serially along the length of a retaining pole, one such retaining pole for each of said two entangling preventer halves;

each of said retaining poles further comprises a pole latch configured to mate with its corresponding said pole latch securing receptacle; and each of said retaining poles and its corresponding entangling preventer half are configured in relation to one another such that each of said N necklace chain threading retainers on said retaining pole can be descended into a position in which said retainer circumscribes its corresponding chain threading hook while said pole latch simultaneously descends into its corresponding said pole latch securing receptacle and mates therewith, for retaining a corresponding already-threaded necklace chain within said interior region of said hook while said retainer circumscribes its said corresponding necklace hook.

5. The apparatus of claim 4, each of said entangling preventer halves further comprising a pole guide and stabilizer for guiding said pole retainer while said corresponding pole retainer is descended, and while said pole retainer is retaining the threaded necklace chains within said interior regions of their respective said hooks.

6. The apparatus of claim 1, wherein:

each of said threading retainers comprises said opposite plate inverted hook passively-engaged retainer selected from said necklace retainer group;

each of said entangling preventer halves further comprises N inverted hook retainers for retaining necklace chains threaded into said necklace chain threading hooks on the other entangling preventer half;

each of said N inverted hook retainers is fabricated substantially-identically to its corresponding said necklace chain threading hook;

each of said N inverted hook retainers is integrally mounted to protrude from its said entangling preventer half in a direction opposite from, and to be inverted relative to, said necklace chain threading hooks on its said entangling preventer half; and each of said inverted hook retainers and its corresponding necklace chain threading hook on the other entangling preventer half are configured in relation to one another such that when a necklace chain has been threaded through said corresponding necklace chain threading hook and said entangling preventer halves have been so-attached to one another behind the user's neck, said inverted hook retainer engages with its said corresponding necklace chain threading hook, for retaining a corresponding already-threaded necklace chain within said interior region of said necklace chain threading hook while said inverted hook retainer is so-engaged with its said corresponding necklace chain threading hook.

7. The apparatus of claim 1, wherein said N is equal to three (3).

8. The apparatus of claim 1, said plate-half attachment facilitator on each of said entangling preventer halves comprising a plurality of permanent magnets; and said opposite mating configurations comprising the permanent magnets permanently affixed to said body plate of said first entangling preventer half being affixed thereto with opposite magnetic polarity orientation relative to said permanent magnets affixed at corresponding positions to said body plate of said second entangling preventer half.

9. The apparatus of claim 1, each said end of each said necklace chain threading hook further comprising a retention bead permanently affixed thereto, for additionally keeping the corresponding already-threaded necklace chain threaded within said interior region of its said hook while said hook is slid over its said corresponding necklace chain; and said separation between said ends of said necklace chain threading hooks and said body plates comprising the separation between said retention beads and said body plates.

10. A method for preventing necklace chains of a plurality of $1<N\leq 3$ necklaces simultaneously worn by a user thereof from entangling, comprising:

providing a necklace chain entangling preventer apparatus comprising a first entangling preventer half and a second entangling preventer half, each said entangling preventer half comprising a substantially flat rigid body plate with a plurality of N substantially rigid necklace chain threading hooks;

joining the two ends of each of said N necklaces together using necklace end-clasping hardware of the necklaces and thereby hanging the N necklaces about the user's neck;

holding said first and second entangling preventer halves in front of the user's upper torso proximate said necklaces, with said necklace chain threading hooks of said two entangling preventer halves facing inwards toward one another;

threading each one of the N necklaces into an interior region substantially circumscribed by its corresponding said chain threading hook, by passing the necklace chain through a necklace chain threading separation between and end of its necklace chain threading hook and said body plate and into said interior region of its chain threading hook, without utilizing the end-clasping hardware;

with said N necklaces threaded into said necklace said chain threading hooks, sliding each of said entangling preventer halves from their positions in front of the user's upper torso, around and then behind the back of the user's neck, while synchronously rotating each of said entangling preventers half about its long axis;

attaching said first entangling preventer half with said second entangling preventer half behind the user's neck, using a plate-half attachment facilitator permanently affixed to each of said body plates of said entangling preventer halves; and said necklace chain threading hooks of said two entangling preventer halves attached to one another behind the user's neck vertically separating from one another, the N necklace chains threaded therethrough; wherein:

said plate-half attachment facilitators are affixed to their respective rigid body plates with opposite mating configurations;

except for said plate-half attachment facilitators being affixed to their respective rigid body plates with opposite mating configurations, said two entangling preventer halves are otherwise substantially identical; and providing each said entangling preventer half with a plurality of N necklace chain threading retainers, each of said N threading retainers, selected from the necklace retainer group consisting of: a malleable material retainer, a pivot retainer, a pole retainer, and an opposite plate inverted hook passively-engaged retainer.

11. The method of claim 10, further comprising:

each of said N threading retainers comprising said malleable material retainer selected from said necklace retainer group;

each of said N threading retainers corresponding to one of said necklace chain threading hooks on the same entangling preventer half;

each necklace chain threading retainer configured to extend over a side of its corresponding said necklace chain threading hook;

holding said first and second entangling preventer halves in front of the user's upper torso proximate said necklaces, with said necklace chain threading retainers of said two entangling preventer halves likewise facing inwards toward one another;

so-threading each one of the N necklaces into said interior region substantially circumscribed by its corresponding said chain threading hook; and pressing each said necklace chain threading retainer against its corresponding necklace chain threading hook to retain its corresponding already-threaded necklace chain in its threaded positional within said interior region of its said necklace chain threading hook; and with said N necklaces threaded into said necklace said chain threading hooks and additionally retained by said necklace chain threading retainers, sliding each of said entangling preventer halves from their positions in front of the user's upper torso, around and then behind the back of the user's neck, while synchronously rotating each of said entangling preventers halves about its long axis, wherein each of said N threading retainers comprises a material with sufficient malleability and rigidity to retain its corresponding necklace chain during said sliding and rotation, in its already-threaded position within said interior region of said hook.

12. The method of claim 10, further comprising:

each of said N threading retainers comprising said pivot retainer selected from said necklace retainer group;

each of said pivot retainers corresponding to one of said necklace chain threading hooks on the same entangling preventer half;

each of said entangling preventer halves further comprising N pivot necks integrally fabricated therewith;

each of said N pivot retainers integrally fabricated with a pivot loop proximate an opposite end thereof;

each said pivot loop configured for pivoting about its corresponding said pivot neck;

holding said first and second entangling preventer halves in front of the user's upper torso proximate said necklaces, with said necklace chain threading retainers of said two entangling preventer halves likewise facing inwards toward one another;

so-threading each one of the N necklaces into said interior region substantially circumscribed by its corresponding said chain threading hook;

pivoting each said necklace chain threading retainer down into a position in which said retainer circumscribes its corresponding chain threading hook with the corresponding necklace chain already threaded within said interior region of said hook; and with said N necklaces threaded into said necklace chain threading hooks and additionally retained by said pivot retainers, sliding each of said entangling preventer halves from their positions in front of the user's upper torso, around and then behind the back of the user's neck, while synchronously rotating each of said entangling preventers halves about its long axis, with each of said N pivot retainers retaining its corresponding necklace chain during said sliding and rotation, in its already-threaded position within said interior region of said hook.

13. The method of claim 10, further comprising:

each of said N threading retainers comprising said pole retainer selected from said necklace retainer group;

each of said pole retainers corresponding to one of said necklace chain threading hooks on the same entangling preventer half;

each of said entangling preventer halves further comprising a pole latch securing receptacle;

each of said N necklace chain threading retainers fabricated integrally with and serially along the length of a retaining pole, one such retaining pole for each of said two entangling preventer halves;

each of said retaining poles further comprising a pole latch configured to mate with its corresponding said pole latch securing receptacle;

holding said first and second entangling preventer halves in front of the user's upper torso proximate said necklaces, with said necklace chain threading retainers of said two entangling preventer halves likewise facing inwards toward one another;

so-threading each one of the N necklaces into said interior region substantially circumscribed by its corresponding said chain threading hook;

descending each of said N necklace chain threading retainers on said retaining pole into a position in which said retainer circumscribes its corresponding chain threading hook while simultaneously descending and mating said pole latch into its corresponding said pole latch securing receptacle, with the corresponding necklace chain already threaded within said interior region of said hook; and with said N necklaces threaded into said necklace chain threading hooks and additionally retained by said pole retainers, sliding each of said entangling preventer halves from their positions in front of the user's upper torso, around and then behind the back of the user's neck, while synchronously rotating each of said entangling preventers halves about its long axis, with each of said N pole retainers retaining its corresponding necklace chain during said sliding and rotation, in its already-threaded position within said interior region of said hook.

14. The method of claim 13, further comprising:

each of said entangling preventer halves further comprising a pole guide and stabilizer;

guiding said mating by positioning each said pole retainer to contact its corresponding said pole guide and stabilizer while so-descending said pole retainer to retain the threaded necklace chains within said interior regions of their respective said hooks.

15. The method of claim 10, further comprising:

each of said N threading retainers comprising said opposite plate inverted hook passively-engaged retainer selected from said necklace retainer group;

each of said opposite plate inverted hook passively-engaged retainers corresponding to one of said necklace chain threading hooks on the other entangling preventer half;

each of said N inverted hook retainers fabricated substantially-identically to its corresponding said necklace chain threading hook;

each of said N inverted hook retainers integrally mounted to protrude from its said entangling preventer half in a direction opposite from, and to be inverted relative to, said necklace chain threading hooks on its said entangling preventer half;

so-threading each one of the N necklaces into said interior region substantially circumscribed by its corresponding said chain threading hook;

with said N necklaces threaded into said necklace chain threading hooks, sliding each of said entangling preventer halves from their positions in front of the user's upper torso, around and then behind the back of the user's neck, while synchronously rotating each of said entangling preventers halves about its long axis, with each of necklace in its already-threaded position within said interior region of its associated said hook; and so-attaching said first entangling preventer half with said second entangling preventer half behind the user's neck, wherein, simultaneously with said attaching, said inverted hook retainer engages with its said corresponding necklace chain threading hook on the other entangling preventer half and thereby retains a corresponding already-threaded necklace chain within said interior region of said necklace chain threading hook by virtue of said inverted hook retainer so-engaging with its said corresponding necklace chain threading hook.

16. The method of claim 10, wherein said N is equal to three (3).

17. The method of claim 10, said plate-half attachment facilitator on each of said entangling preventer halves comprising a plurality of permanent magnets;

permanently affixing said permanent magnets to said body plate of said first entangling preventer half being affixed thereto with opposite magnetic polarity orientation relative to said permanent magnets affixed at corresponding positions to said body plate of said second entangling preventer half; and attaching said first entangling preventer half with said second entangling preventer half behind the user's neck by moving the oppositely-polarized magnets sufficiently proximate to one another such that the preventer halves naturally snap together into proper alignment without the user having to press to two preventer halves together.

18. The method of claim 10, further comprising additionally keeping the corresponding already-threaded necklace chain threaded within said interior region of its said hook while said hook is slid over its said corresponding necklace chain, using a retention bead permanently affixed to said end of said necklace chain threading hook; said said separation between said ends of said necklace chain threading hooks and said body plates comprising the separation between said retention beads and said body plates.

19. A method of producing a necklace chain entangling preventer apparatus for preventing necklace chains of a plurality of $1<N\leq3$ necklaces from entangling when simultaneously worn by a user thereof, comprising:

providing a substantially flat rigid first body plate;

permanently affixing a plurality of N substantially rigid necklace chain threading hooks to said first body plate with a necklace chain threading separation between ends of said necklace chain threading hooks and said first body plate, each said hook and separation configured for enabling the necklace chain of one of the N necklaces to be threaded into an interior region substantially circumscribed by said hook by passing the necklace chain through said separation and into said interior region, without utilizing end-clasping hardware of the necklaces, and for enabling each of said first body plate and its hooks to be freely slid over said chain thereafter;

providing a plurality of N necklace chain threading retainers for said first body plate, selected from the necklace retainer group consisting of: a malleable material retainer, a pivot retainer, a pole retainer, and an opposite plate inverted hook passively-engaged retainer;

providing a substantially rigid second body plate;

permanently affixing a plurality of N substantially rigid necklace chain threading hooks to said second body plate in the same manner as said hooks are affixed to first flat rigid body plate, thereby replicating the assemblage of the first body plate and its said hooks with a duplicate assemblage of said second body plate and its said hooks;

providing a plurality of N necklace chain threading retainers for said second body plate, selected from the necklace retainer group consisting of: a malleable material retainer, a pivot retainer, a pole retainer, and an opposite plate inverted hook passively-engaged retainer, in substantially the same configuration as for said first body plate;

permanently affixing a plate-half attachment facilitator to said first body plate in a first plate mating configuration; and permanently affixing a plate-half attachment facilitator to said second body plate in a second plate mating configuration opposite said first plate mating configuration; wherein:

said first and second rigid body plates and their necklace chain threading hooks and plate-half attachment facilitator and retainers respectively comprise first and second entangling preventer halves of said necklace chain entangling preventer apparatus;

said entangling preventer halves with their said opposite mating configurations are capable of being attached to one another using said attachment facilitators; and so-affixing said necklace chain threading hooks in positions to vertically separate the N necklace chains from one another when the N necklaces have been threaded therethrough and the two entangling preventer halves have been attached to one another behind a user's neck.

20. The method of claim 19, further comprising:

each of said N threading retainers comprising said malleable material retainer selected from said necklace retainer group;

each of said malleable material retainers corresponding to one of said necklace chain threading hooks on the same entangling preventer half;

permanently affixing said malleable material retainers to said first body plate, each of said N threading retainers configured to extend over a corresponding side of one of said N necklace chain threading hooks, with each of said N threading retainers comprising a material with sufficient malleability and rigidity to enable said necklace chain threading retainer to be pressed against its corresponding necklace chain threading hook for retaining a corresponding already-threaded necklace chain threaded within said interior region of said hook while said hook is slid over its said corresponding necklace chain;

permanently affixing said malleable material retainers to said second body plate in the same manner as said retainers are affixed to said first rigid body plate, thereby replicating the assemblage of the first body plate and its said retainers with a duplicate assemblage of said second body plate and its said retainers; wherein:

said malleable material retainers likewise comprise part of said first and second entangling preventer halves of said necklace chain entangling preventer apparatus.

21. The method of claim 19, further comprising:

each of said N threading retainers comprising said pivot retainer selected from said necklace retainer group;

each of said N threading retainers corresponding to one of said necklace chain threading hooks on the same entangling preventer half;

fabricating each of said entangling preventer halves integrally with N pivot necks thereof;

fabricating each of said N pivot retainers for each entangling preventer half integrally with a pivot loop proximate an opposite end thereof;

permanently assembling each said first body plate pivot loop with said first body plate to be able to pivot down about its corresponding said pivot neck into a position in which said pivot retainer circumscribes its corresponding chain threading hook, for retaining a corresponding already-threaded necklace chain within said interior region of said hook while said pivot retainer circumscribes its said corresponding necklace hook.

permanently assembling each said second body plate pivot loop with said second body plate in the same manner as for said first flat rigid body plate, thereby replicating the assemblage of the first body plate and its said retainers with a duplicate assemblage of said second body plate and its said retainers; wherein:

said pivot retainers likewise comprise part of said first and second entangling preventer halves of said necklace chain entangling preventer apparatus.

22. The method of claim 19, further comprising:

each of said N threading retainers comprising said pole retainer selected from said necklace retainer group;

each of said N threading retainers corresponding to one of said necklace chain threading hooks on the same entangling preventer half;

fabricating each of said entangling preventer halves integrally with a pole latch securing receptacle;

fabricating each of said N necklace chain threading retainers integrally with and serially along the length of a retaining pole, one such retaining pole for each of said two entangling preventer halves;

further fabricating each of said retaining poles integrally with a pole latch configured to mate with its corresponding said pole latch securing receptacle; and fabricating each said retaining pole and its corresponding entangling preventer half in relation to one another such that each of said N necklace chain threading retainers on said retaining pole can be descended into a position in which said retainer circumscribes its corresponding chain threading hook while said pole latch simultaneously descends into its corresponding said pole latch securing receptacle and mates therewith, for retaining a corresponding already-threaded necklace chain within said interior region of said hook while said retainer circumscribes its said corresponding necklace hook; wherein:

said pole retainers likewise comprise part of said first and second entangling preventer halves of said necklace chain entangling preventer apparatus.

23. The method of claim 22, further comprising fabricating each of said entangling preventer halves integrally with a pole guide and stabilizer, positioned for guiding its corresponding pole retainer while said corresponding pole retainer is descended, and while said pole retainer is retaining the threaded necklace chains within said interior regions of their respective said hooks.

24. The method of claim 19, further comprising:

each of said threading retainers comprising said opposite plate inverted hook passively-engaged retainer selected from said necklace retainer group;

each of said entangling preventer halves further comprising N inverted hook retainers for retaining necklace chains threaded into said necklace chain threading hooks on the other entangling preventer half;

fabricating each of said N inverted hook retainers substantially-identically to its corresponding said necklace chain threading hook;

mounting each of said N inverted hook retainers integrally to its said entangling preventer half to protrude in a direction opposite from, and to be inverted relative to, said necklace chain threading hooks on its said entangling preventer half; and fabricating each of said inverted hook retainers and its corresponding necklace chain threading hook on the other entangling preventer half are configured in relation to one another such that when a necklace chain has been threaded through said corresponding necklace chain threading hook and said entangling preventer halves have been so-attached to one another behind the user's neck, said inverted hook retainer engages with its said corresponding necklace chain threading hook, for retaining a corresponding already-threaded necklace chain within said interior region of said necklace chain threading hook while said inverted hook retainer is so-engaged with its said corresponding necklace chain threading hook; wherein:

said opposite plate inverted hook passively-engaged retainers likewise comprise part of said first and second entangling preventer halves of said necklace chain entangling preventer apparatus.

25. The method of claim 19, wherein said N is equal to three (3).

26. The method of claim 19, further comprising said plate-half attachment facilitator on each of said entangling preventer halves comprising a plurality of permanent magnets; and permanently affixing said permanent magnets to said first body plate of said first entangling preventer half;

permanently affixing said permanent magnets to said second body plate of said second entangling preventer half with opposite magnetic polarity orientation relative to permanently said permanent magnets affixed at corresponding positions to said first body plate of said second entangling preventer half.

27. The method of claim 19, further comprising:

permanently affixing a retention bead to each said end of each said necklace chain threading hook, for additionally keeping the corresponding already-threaded necklace chain threaded within said interior region of its said hook while said hook is slid over its said corresponding necklace chain; and said separation between said ends of said necklace chain threading hooks and said body plates comprising the separation between said retention beads and said body plates.

* * * * *